United States Patent [19]

Sumner

[11] 3,974,657

[45] Aug. 17, 1976

[54] MODULAR OFFSHORE STRUCTURE SYSTEM

[76] Inventor: Maurice N. Sumner, 1718 Lubbock St., Houston, Tex. 77007

[22] Filed: Jan. 8, 1975

[21] Appl. No.: 539,300

Related U.S. Application Data

[60] Division of Ser. No. 243,790, April 13, 1972, Pat. No. 3,874,180, which is a division of Ser. No. 107,288, Jan. 18, 1971, Pat. No. 3,716,993, which is a continuation-in-part of Ser. No. 649,889, June 29, 1967, Pat. No. 3,575,005.

[52] U.S. Cl. ..... 61/50; 61/98; 114/.5 D

[51] Int. Cl.[2] ..... E02D 27/38

[58] Field of Search ..... 61/46.5, 46, 50, 52; 52/224, 648; 220/1 B, 18, 17.1; 114/.5 D

[56] References Cited

UNITED STATES PATENTS

| | | | |
|---|---|---|---|
| 3,385,464 | 5/1968 | Courbon | 61/46.5 X |
| 3,429,133 | 2/1969 | Hauser | 61/46.5 |
| 3,486,343 | 12/1969 | Gibson et al. | 61/46.5 |
| 3,626,701 | 12/1971 | Laffont | 61/46.5 |
| 3,645,104 | 2/1972 | Hogan | 61/46.5 |
| 3,648,466 | 3/1972 | Houdin | 61/50 |

*Primary Examiner*—Jacob Shapiro
*Attorney, Agent, or Firm*—Kenneth H. Johnson

[57] ABSTRACT

A modular-like system of offshore structures for imparting flexibility to the offshore exploration and production and transportation industries so that exploration, production and development work can take place over a large range of marine depths and operational circumstances with one or more marine vessels.

3 Claims, 102 Drawing Figures

INVENTOR.

BY

MODULAR OFFSHORE STRUCTURE SYSTEM

CROSS REFERENCES

This specification is a division of application Ser. No. 243,790 filed Apr. 13, 1972, now U.S. Pat. Ser. No. 3,874,180; which is a division of Ser. No. 107,288 filed Jan. 18, 1971, now U.S. Pat. Ser. No. 3,716,993, which is a continuation-in-part of Ser. No. 649,889 filed June 29, 1967, now U.S. Pat. Ser. No. 3,575,005.

This application is a continuation-in-part of my earlier application, Ser. No. 107,288, filed Jan. 18, 1971, which is a continuation-in-part of my earlier application Ser. No. 649,889, filed June 29, 1967, now U.S. Pat. No. 3,575,005.

BACKGROUND OF THE INVENTION

There is in the offshore drilling, production, and transportation industry a variety of structures for supporting men and machinery at stations offshore. The structures are similar in basic function, namely to support the men and machinery in accomplishing their assigned functions. Otherwise the structures are significantly different in that some are mobile while others are stationary; and some are founded on the marine floor while others float. The mobile structures are commonly called "mobile rigs" while the fixed ones are "fixed platforms". These rigs and platforms are generally classified as either drill ships, semi-submersibles, submersibles, jackups, pile jackets, or one of a few other hybrid designs. Each is peculiarly designed and adapted for a fairly limited set of operational conditions. As a result, there is restrictive flexibility of use. For example, the fixed frame design, commonly known as the aforementioned pile jacket, is best suited for permanent stations in water of a few hundred feet or less. All other current types are mobile and more expensive as a result, and therefore they are well suited for exploration work, but not so well suited for long duration stationary production work. However, even production work is not truly permanent and reusability would be a significant consideration in the design of a rig for production purposes. Fixed platforms are seldom used in exploration work because the cost of building a new platform for each exploratory hole is almost prohibitive, except in shallow, protected waters. Thus fixed platforms are primarily production type structures.

In contrast to the permanent station characterizing the fixed frame design, the most mobile type of offshore platform is the drill ship with its appropriate stabilizing and stationing apparatus such as thrusters, anchors, and winches. The ship certainly is not best suited for permanent stationing because it is particularly sensitive to wave action by reason of the wide surface area of structure exposed to the water, and the use of thrusters to maintain stationing for long periods of time, as would be necessary for production activities, is economically unfeasible because of fuel consumption and the necessarily continuous human monitoring which is required. Also, of course, the ship is vulnerable to storms and generally adverse conditions.

Intermediate the permanent station characterizing the fixed frame and the high mobility of the drill ship are the family of rigs known as jackups. The jackup rig has some of the advantages of both the fixed frame and the drill ship. It is analogous to the former in that it is supported on the marine floor, and therefore is quite stable and requires no continuous operation or monitoring to maintain position. And, when the legs are raised, it can be towed from place to place so as to thereby provide a degree of mobility analogous to the drill ship. The legs can, of course, be lowered to varying elevations so as to provide the jackup with an adaptability to a variety of depths.

The aforementioned submersibles are also an intermediate form of rig. The submersibles and also the semi-submersibles have good stability, each is suited to its depth, the semi-submersible to deep water, the submersible bottom-founded frame to shallow water. Both are more stable but less mobile than the drill ship. They cannot be moved in heavy weather without jeopardy to themselves, their crew, and the towing vessel; and indeed some have even been lost while being moved in calm waters.

It thus becomes evident without further elaboration that each of the various types of offshore drilling rigs commonly used is well suited only to a relatively narrow range of operation. As a result, a company or firm which chooses to operate offshore must elect the particular type of rig best suited for its contemplated initial endeavor and thereafter be committed to the limitations of that rig when it is used in subsequent drilling operations.

The limitations inherent in the state of the art are best illustrated by a brief examination of one of the more common types of mobile rig. The jackup rig, as previously noted, has certain of the advantageous characteristics of the pile jacket in that it is founded on the bottom in a stable way while the apparatus it carries is supported clear of the highest anticipated waves so that the whole is a fairly stable semi-permanent, albeit expensive, station. Mobility is achieved by lowering its bouyant platform to the water, and raising the legs from the marine floor, so that the whole can then be floatably moved to another location. Although jackup rigs in general are adapted to a relatively wide range of operating depths, namely about 20 to perhaps 500 feet, any single jackup is adapted, as a practical matter, to a very limited subrange within this range. For example, if a jackup of the prior art were to be designed for work in the Gulf of Mexico in water of 200 foot depth, it certainly could not work in depths of 400 feet because its legs would not reach the bottom. Likewise, it could not work competitively, that is economically, in water depths of say 60 feet because other less expensive jackup rigs would be available for that work. So, although in a physical sense jackup rigs can work in a wide range of depths, they cannot in an individual and in an economic sense encompass a very large range of usefulness.

Therefore, it might be concluded from the above brief discussion that the offshore operator is restricted to a fixed location rig which represents a substantial investment, or to a mobile rig which represents a very substantial investment but which is adapted only to a relatively narrow range of operational depths which may represent a certain class of locations.

SUMMARY OF THE INVENTION

The present invention endeavors to broaden the flexibility in use for offshore mobile rigs and ancillary structures, and to allow a wider variety of choices than presently exist. This is accomplished not by a specific modification to a particular type of existing rig, but by presenting the concept of an entire new family of modular elements which are adapted to cooperate with one another in order to provide a plurality of alternative structures which enable the user to operate an offshore drilling platform in a much broader range of depths and environmental circumstances than is presently known in the art. Briefly, and more specifically, the present invention is directed to a modular system of offshore structures consisting of one or more marine vessels which are adapted to cooperate with a variety of supporting structures and which are cooperatively operable in varying manners by being coupled together by a spacing-jack-and-coupling-structure. In more elaborate embodiments, the supporting structure will be incorporated into the spacing-jack-and-coupling-structure, so that the whole may serve a spacing-jack-and-coupling-structure for another supporting structure. In varying circumstances a releaseable connection means is also provided for releasing the vessel from the structure or the structure from the vessel. This aforesaid releasable connection means may take a variety of forms. In one form it may release the spacing-jack-and-coupling-structure from the vessel and not from the support structure. More commonly it may release the spacing-jack-and-coupling-structure from the support structure and not from the vessel. Sometimes both are done, and sometimes multiple releasable structures are formed into a whole by multiple releasable connection means. As a consequence of the factors of releasability and modularity, there is provided a family of individually independent but cooperating elements that afford much greater flexibility in use than has been known before in the offshore structures art. Therefore, a particular feature and advantage of this invention is its disclosure of a mobile rig for offshore operations which may be designed for a given purpose, such as competitive economical drilling in shallow water, but due to its inherent structural modularity characteristics it is adaptable to many varying functional applications, including drilling at much greater depths.

Another feature and advantage of the invention resides in a plurality of modules for reversibly converting a floating rig to a fixedly founded rig.

Still another feature and advantage of the invention is the provision for a plurality of structural modules which may convert a jackup rig to a semi-submersible and subsequently to a drill ship.

Yet another feature and advantage of the invention is the provision for a means for raising vessels out of the water and lowering vessels into the water regardless of whether the weight of the vessels is supported by the marine floor or by bouyance of the water.

Still another feature and advantage of the invention resides in the means and method for coupling marine structures and vessels together in order to markedly enhance their operational value.

A still further feature and advantage of the invention resides in a modular family of structures which enables a manufacturer to fulfill the changing requirements of his customers by converting a given rig from a first functional design to another functional design.

These and numerous other features and advantages of the invention will become more readily apparent upon a careful reading of the following detailed description, claims, and drawings wherein like numerals denote like parts in the plurality of views and wherein:

FIG. 1 schematically represents and illustrates the principal modular components of the system and their relationship to one another.

In my earlier filed application Ser. No. 649,889, filed June 29, 1967, now U.S. Pat. No. 3,575,005, there was disclosed a multi-purpose vessel and a multi-purpose structure which through mutual cooperation permitted the vessel to navigably support the structure free of impediment and to alternatively allow the structure to stably support the vessel free of detrimental environment. There was also disclosed a method whereby the vessel could be navigated to an operating site in the water, founded and moved to another operating site, leaving behind at the prior operating site an operational platform which, in itself, could later serve as the means for founding a later arriving vessel. The present invention markedly enhances this prior disclosure by setting forth the means and methods by which a modular system of vessels, supporting structures, and releasable coupling means may be used interchangeably in the systems and methods not only set forth in said earlier application, but also in other uses. Therefore, the present invention increases the functional flexibility of the apparatus described in my earlier disclosure and also explains the manner and means by which present day offshore equipment can be modified or constructed in less specialized manner so as to thereby increase the profits of offshore operations by increasing the scope of operational functions for individual structures.

Figure 1:
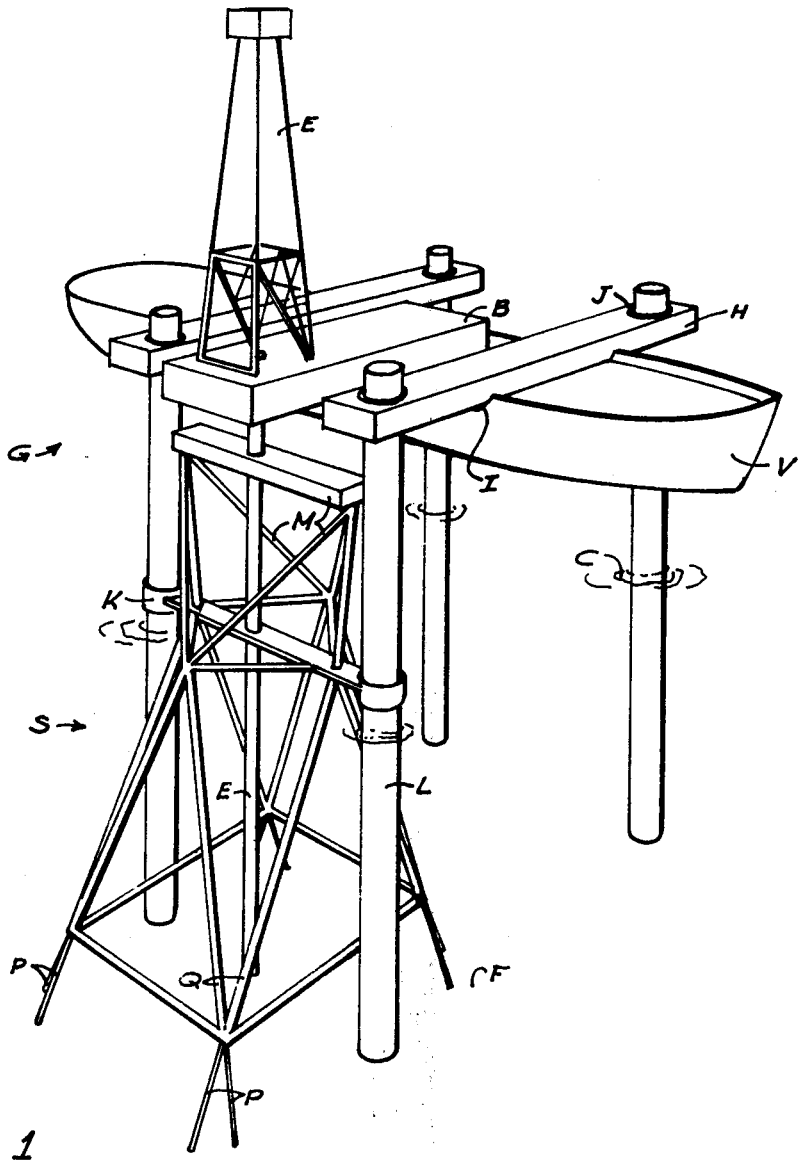

For the purpose of setting forth the invention, it may be assumed that a manufacturer of offshore drilling rigs has determined to offer to the offshore industry a single form of vessel which will accomplish numerous types of drilling functions that may now only be obtained with a plurality of different drilling rigs. Such a vessel and its related operational system is disclosed in such exemplary fashion in FIG. 1. It is pointed out, however, that FIG. 1 is only a suggested configuration of the vessel and is disclosed solely for exemplary purposes. Therefore, a manufacturer may recognize and design an even more versatile configuration of the vessel that might make it more readily adaptable to the hereinafter interchangeable modular concept which is the subject of this invention.

In order to facilitate identification of the component parts in the various drawings, the following legend is set forth:

A Apparatus for operations
B Skid or base, movable on deck
C Water line
D Production apparatus
E Exploration apparatus
F Marine floor
G Spacing-jack-and-coupling-means, comprising H, I, J, K, and L
H Jackholder
I Coupling, jackholder to vessel
J Coupling, jacking module to jackholder
K Coupling, apparatus G to station module
L Jacking module
M Station module, main separable element for lending support
O Petroleum
P Pile module of support structure
Q Pile receiving means of support structure
S Assembled set of support structures including modules such as L or M
T Tugboat
V Vessel
W Vessel
X Apparatus of the prior art

DETAILED DESCRIPTION

With reference now to FIG. 1, there is shown the vessel V which carries one or more jackholders H that consist of a structural cross-member generally lying normal to the longitudinal axis of the vessel. The jackholders H are characterized by a coupling means I that affixes jackholders H to the vessel V. The tubular jacking modules L function to stabilize and/or raise vessel V and are affixed to jackholders H by couplings J. The station module M constitutes a support structure which may be adapted to cooperate with jacking modules L and which is founded by piles P that are driven into the marine floor F. Couplings K secure the jacking modules L to the station module M in order to enhance stability of the system.

The releasable spacing-jack-and-coupling-means may, as a unit, be designated hereafter simply as means G and therefore comprises the aforementioned components H, I, J, K, and L. The spacing-jack-and-coupling-means cooperates with the vessel V and the station structure M in order to raise and lower the vessel and to position and to re-position the structure M in any of a number of positions relative to vessel V. The spacing-jack-and-coupling-means G may especially be used to provide structural coupling of the vessel to the station structure M so that the latter may lend support, such as against overturning, to coupling means G and also to thereby protect against sinking of vessel V as a consequence of its connection to the spacing-jack-and-coupling-means G. As will be discussed hereafter, such as for example with respect to the series or drawings beginning with FIG. 7, the couplings I, J, and K may be releasable for a number of purposes but for the principal purpose of allowing substitution of one module for another. Therefore it will be readily evident that the vessels V, station structures M, and the apparatus generally referred to as coupling means G are at least partly releasable so as to allow the vessel V to depart the structure M, or to allow the vessel V to depend on the structure M for stability, and to allow the structure M to depend on the vessel V for support, all in varying circumstances. Briefly, a basic operational sequence comprises the steps of utilizing the vessel V to carry the structure M, that is a supporting or similar structure, to a location or the water, stationing the structure M at such location, changing the elevation of the vessel with respect to the water by means of cooperative utilization of the structure M, conducting work operations, again changing the elevation of the vessel so as to bring it to its normal mobile condition and releasing the vessel from the stationed structure M and navigating the vessel away therefrom. Of paramount importance in the varying operational sequences that embody the invention is the cooperating utilization of connectors I, J, and K such that the stability of the vessel is independent of water depth and vessel weight and is more significantly affected by the depth of the connector K and the stability of the structure M. This feature wherein be more fully appreciated upon reading the following disclosure wherin its use is shown in varying operational circumstances.

The modular components of FIG. 1 are now illustrated in more particularlity with respect to their proposed operational endeavors and in which operational flexibility will become readily evident. In the sequence of FIGS. 2–6 is shown a modular system in which the vessel can operate as a jackup in particularly deep water, wherein a ringlike domed station module 10 serves as a mat or as a pile-supported support and storage structure, as may be desired. In effect there is shown what might be called a footless jackup in which the legs 11 do not reach the marine floor. The vessel V carries jackholder 20 releasably affixed thereto by welds 17, and having legwells 18 housing jack means therein, and holding jack modules (legs) 11 therein, residing releasably and adjustably above the water, all approaching a structure $S_0$. The structure $S_0$ comprises the domed toroidal ring 10 having pile guide and holding sleeves 16 therethrough, and having legs 12 standing on coupling welds 15 thereon, and with coupling sockets 14 at the tops of legs 12 for receiving stabbing points 13 of the legs 11.

Figure 2:
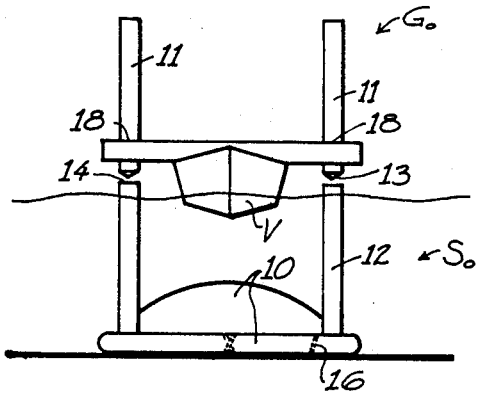
FIGS. 2–6 illustrate a jackup structure which does not contact the marine floor in the usual and conventional manner.
Figure 3:
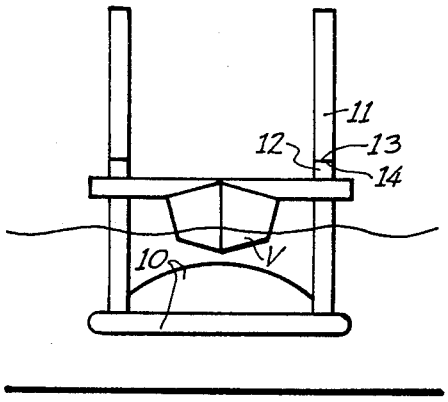

The sequence of operations pictured is as follows: In FIG. 2 the vessel V positions itself between the legs 12 preparatory to stabbing the points 13 of the legs 11 into the sockets 14. Then the legs 11 are welded to the legs 12 and they become a unitary whole, allowing the spacing-jack-and-coupling-means $G_0$ to elevate structure $S_0$ to the position shown in FIG. 3, whereafter the newly assembled whole may operate as a mat-type jackup of the prior art, thus obtaining the advantages of such jackups to the vessel V, which was previously apparently only a simple jackup of streamlined shape.

Figure 4:
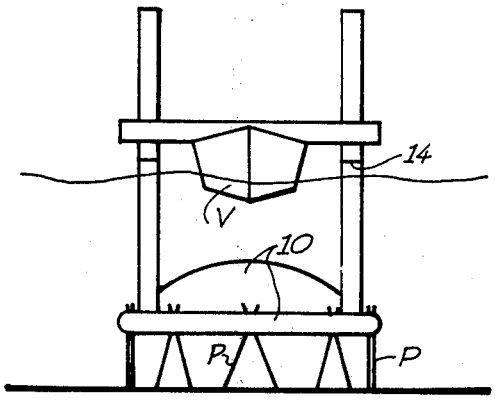
Figure 5:
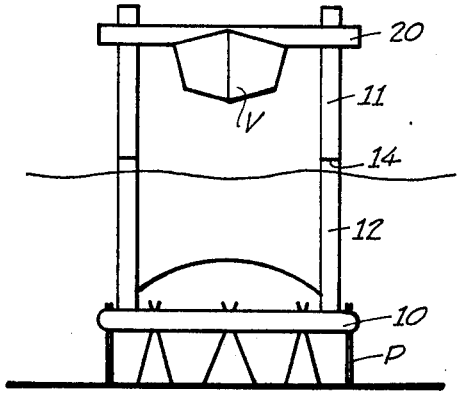
Figure 6:
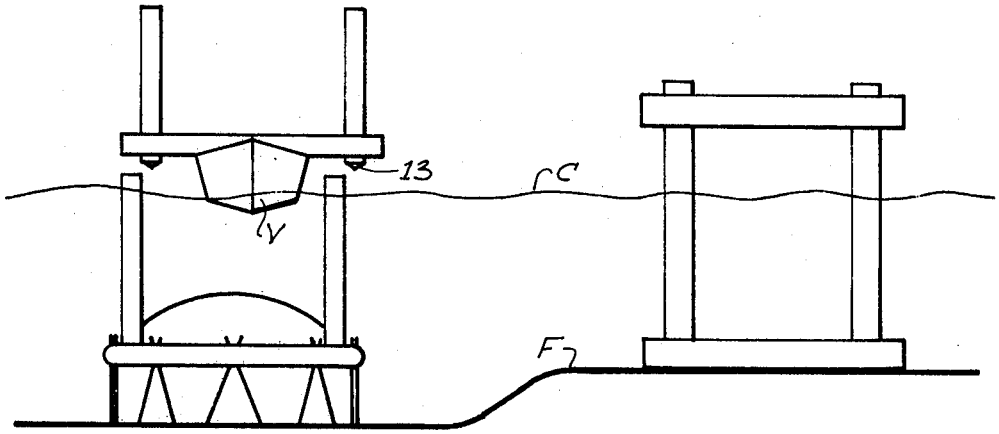
Figure 96:
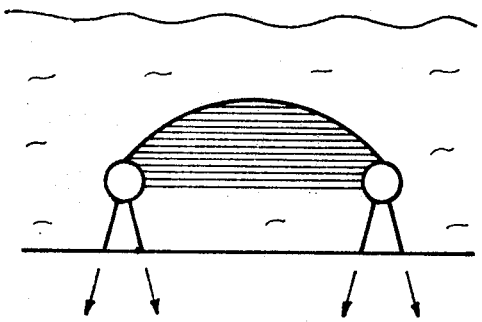

However, many other advantages can be obtained, as will now be shown in FIGS. 4–6. FIGS. 4–6 show that the vessel could optionally support itself on a station module which is founded in the marine floor F by piles P thereby adapting the entire structure to even deeper waters and to uneven floor characteristics. FIG. 4 shows the vessel arrived at a site in deeper water than the water of FIGS. 2 and 3. Piles P have been driven through and secured to the means 16 in the domed ring 10, holding it well clear of the marine floor, and allowing the vessel V to be elevated by the means $G_0$ to the height shown in FIG. 5, which would have been unreachable by other means. Then FIG. 6 shows the vessel returned to the water and the coupling 13 undone from the socket 14 and the vessel V departing from the founded structure $S_0$, which serves functions illustrated in FIGS. 9–96, as will be explained much later. FIG. 6 also shows a mat-type jackup X of the prior art in the shallow neighboring water, which illustrates the greater depth available by employment of the ring of piles in divergent way shown in these figures.

Figure 7:
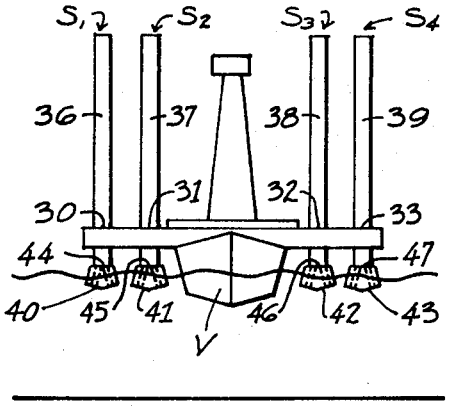
FIGS. 7–30 illustrate, in general, an operational sequence portraying the evolution of a vessel similar to that shown in FIG. 1 from the stage of a drill ship to a pile-supported jackup, then into a jackup much like those of the prior art, then into a modification employing a semi-submersible wave transparent bottle frame (FIGS. 28–30).
Figure 30:
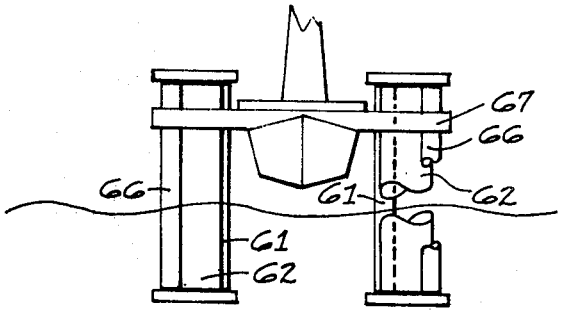

The modular components of FIG. 1 are now illustrated in a modified embodiment beginning with FIG. 7 and extending essentially through FIG. 30. Here the vessel V is substantially the same in each of the 24 views, as are the jackholders 35. In the sequence, jackwells 30, 31, 32, and 33 are fully released but once, and the connectors are not released at all but instead may constitute simple weldments. In FIG. 7 there is shown the vessel V with four thwarts or jackholders 35 housing releasable jackwells or couplings 30, 31, 32, and 33 outboard of the vessel and with the bottom of the jackwells being clear of the water. Four elevating structures $S_1$, $S_2$, $S_3$, and $S_4$ each comprise two jacking modules (legs) 36, 37, 38, and 39, one station module (pontoon) footing 40, 41, 42, and 43 on each leg, and releasable connectors (such as separating weldments) 44, 45, 46, and 47. The coupling wells 30, 31, 32, and 33 clamp legs 36, 37, 38, and 39 in place so that the whole forms a vessel of quintamaran (five hulled) configuration which can move swiftly and stably through the water to the proposed station site and there may operate as a drill ship of an exceptionally stable character. The jackwells 30, 31, 32, and 33 house leg jacking apparatus. Each of the pontoons 40, 41, 42, and 43 has pile receiving means 48 therein, being sleeves therethrough. The rig E rests on its base B, which can serve to skid the rig E far outboard the vessel V.

Figure 8:
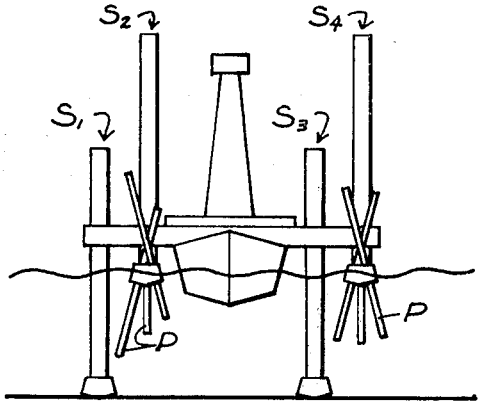
Figure 9:
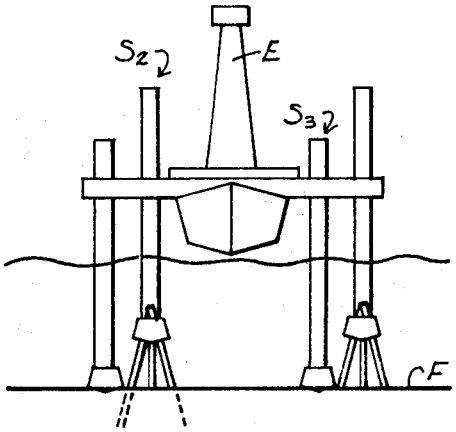
Figure 10:
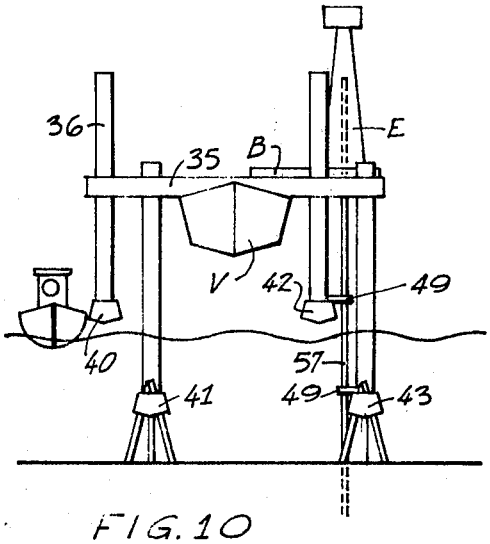
Figure 11:
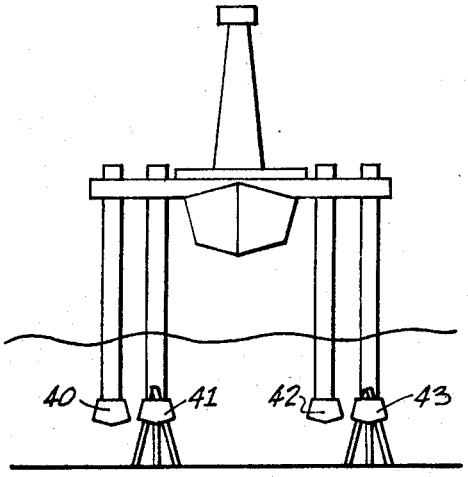

In FIG. 8 the vessel V has arrived at the proposed station site for founded operation. The apparatus $G_1$ is actuated to lower the support structures $S_1$ and $S_3$ to the marine floor F while the crew places piles P in pile receiving means 48 in the station structures 41 and 43 of support structures $S_2$ and $S_4$. The vessel V is then elevated on support structure $S_1$ and $S_3$. In FIG. 9 the piles P are driven and clamped in the pile receiving means 48 sufficiently to bear the weight of the vessel. The apparatus $G_1$ is then actuated to elevate the vessel V, and then actuated to elevate support structures $S_1$ and $S_3$ while supporting the vessel on support structures $S_2$ and $S_4$, and further adjusts the relative elevations to the configuration as shown in FIG. 10. The vessel could not reach such a height without the aid of the piles P. The legs are thus enhanced by being supported at the level of the couplings 44, 45, 46, 47. Here the rig E drills while various features are employed. For example, the pontoon or station module 40 serves as a boat bumper and loading dock. After cargo is loaded on to it, the apparatus $G_1$ can lift the station module 40 to the elevation of the vessel deck, thus serving as a hoist means. The rig E is shifted to drill a well. The pontoons or stations 42 and 43 meanwhile serve with guides 49 as conductor pipe guides and supports for pipe 57. In case of a storm the structures $S_1$ and $S_3$ could be returned to the marine floor or withdrawn clear of the waves, whichever is most suitable to the ambient conditions. FIG. 11 shows completion of the drilling operation and return of sets $S_1$ and $S_3$ nearer to the marine floor F, and of rig E to the center of the vessel. The means $G_1$ operates to lower vessel V to the water.

Figure 12:
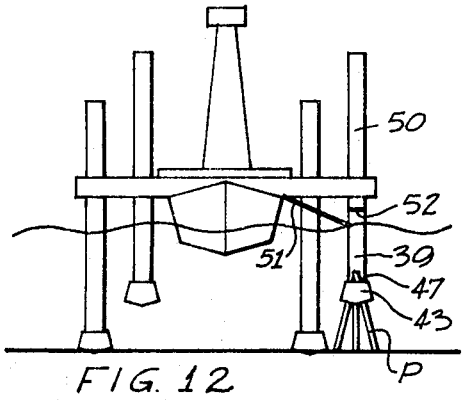
Figure 13:
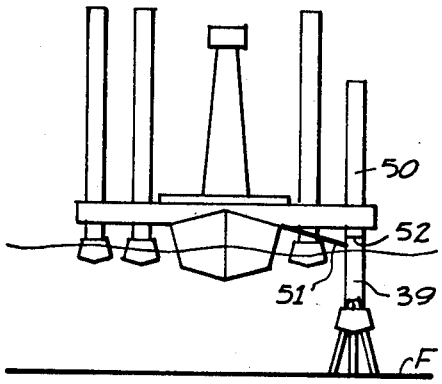

In FIG. 12 the coupled shock absorbing spacer 51, for holding the vessel safety clear of structure $S_4$ is placed from the leg 39 and the vessel V, whereupon the piles P are withdrawn from 43 while the leg 39 is severed at a point 52, made easy by having legwells 30, 31, 32, and 33 clear of the water, yielding an upper outer portion of 39 designated leg 50 and a founded structure comprising elements 43, 39, 47 and piles P. The benefits thus obtained are significant. The bulk of the structure $S_4$ remains as a permanently founded station (FIGS. 13 and 14) with an exposed structure 39 that could receive the vessel V again or which could serve as a mooring for other vessels which may come to tend the well. Since the leg is clear above the water it is easily located by subsequently arriving vessels. Also, the vessel from which the spudwell was severed is of course not incapacitated and may thereafter efficiently carry out additional operations, such as the following.

Figure 14:
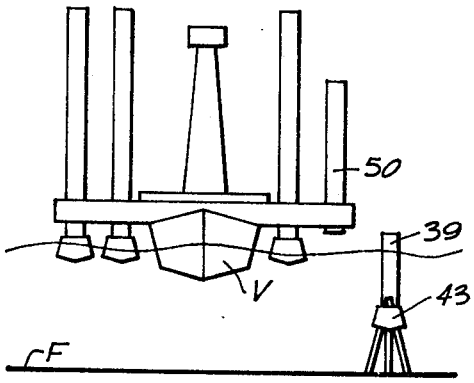
Figure 15:
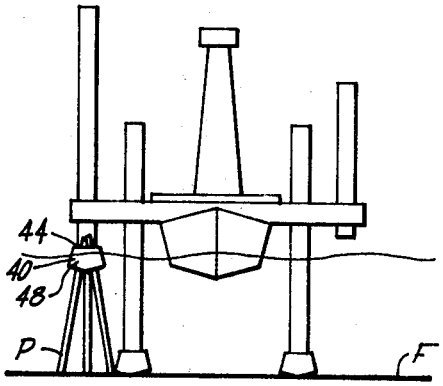
Figure 16:
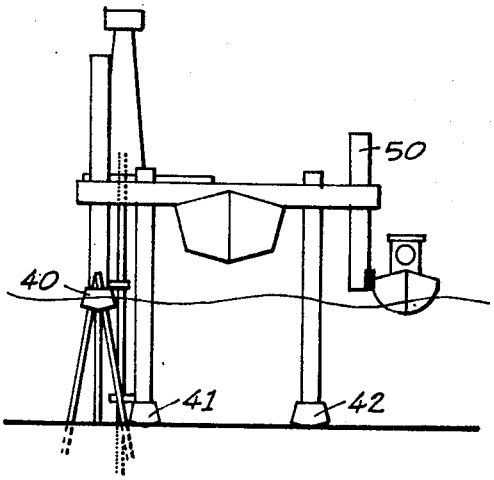
Figure 17:
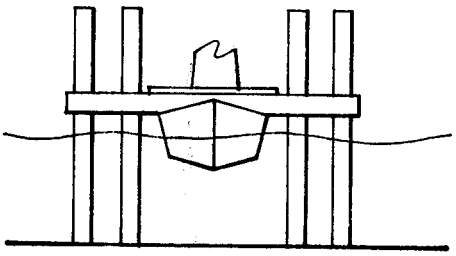
Figure 19:
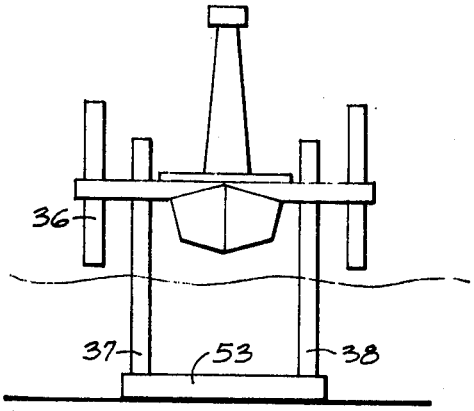
Figure 18:
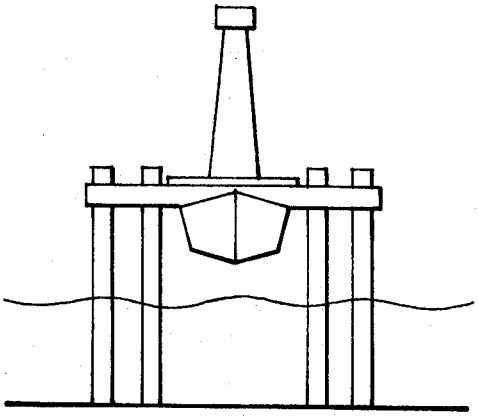

FIG. 15 shows the vessel V at a new site with its same apparatus $G_1$ except for the equipment that was left at the prior site (FIG. 14). The inner set of structures ($S_2$ and $S_3$) are planted on the floor F by the apparatus $G_1$ while piles P are placed in the means 48 of module 40. The vessel V is subsequently raised (FIG. 16) clear of the water by the apparatus $G_1$. A most significant structural feature of the legs is their varying apparent lenght. The coupling 44 is disposed near the water line C while couplings 45 and 46 are relatively lower. At first glance it may seem that the structure 40 is redundant but it should be noted that the principal modes of failure of tablelike structures in an ocean-like enviornment are lateral buckling and over-turning. Thus it should be realized that the stationing module 40 provides substantial benefit in holding the vessel V from swaying sideways, this occurring through the medium of coupling 44. FIG. 17 illustrates the vessel V after the sequence of founding structures 41 and 42, each at a different site, much in the same manner as shown in FIG. 15, except that the legs become successively stripped of the station structures 40, 41, 42, and 43 respectively so that finally (FIG. 17) the entire apparatus can operate but little better than a jackup of the prior art. FIG. 18 illustrates such operation as a jackup rig. FIG. 19 shows, as a modification, that inner legs 37, 38 may be integrally connected through the use of a mat-type module 53 when working on extremely soft bottoms. Thus it is seen that the vessel can operate either as a jackup without the footing-like station modules (FIG. 18) or with a mat (FIG. 19). Thus many advantages accrue to the disclosed structure since a conventional jackup rig can be modified in accordance with the teachings herein.

Figure 20:
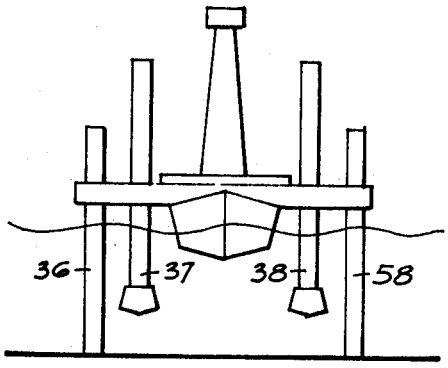
Figure 21:
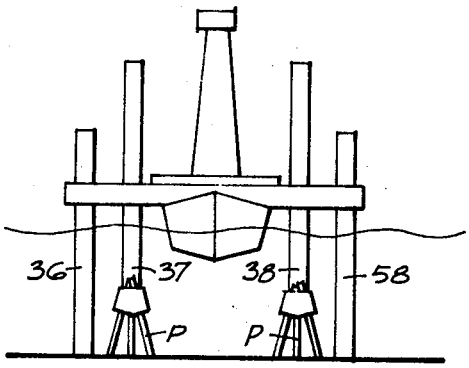
Figure 22:
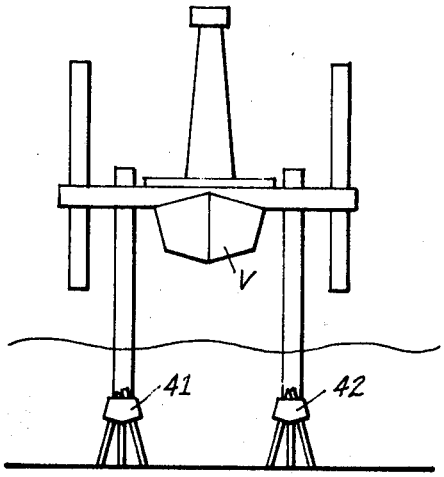

FIGS. 20–22 are set forth to show that legs 36, 37, 38, and 58 need not be operated in the same sequence as described hereinabove. For example, the vessel V may be resupplied with additional legs or jacking modules, this being accomplished such as by a supply vessel. In such case the jacking modules 36, 58, are first lowered to the marine floor F in order to found the vessel V. Original pairs of jacking modules 37, 38, are then lowered to an intermediate depth where piles P may be installed so as to take over the supportive function of the jacking modules 36, 58. The vessel is then elevated on the jacking modules 37, 38, to an operating position above the surface of the water, see FIG. 22.

Figure 23:
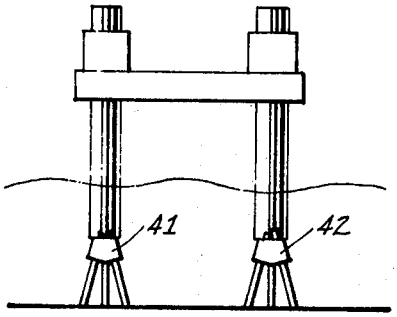
Figure 24:
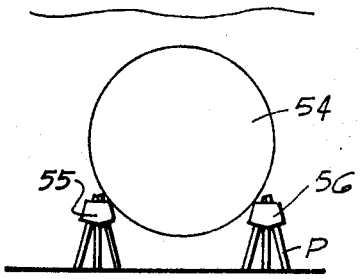
Figure 25:
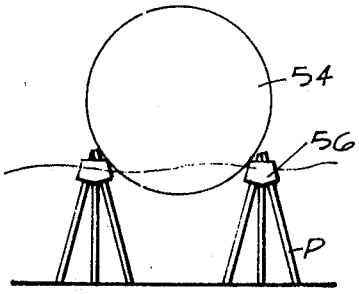
Figure 26:
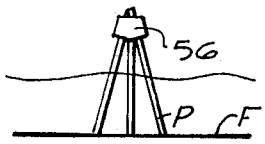

FIG. 23 shows a modification of the aforementioned sequence in which the vessel V is replaced by an ordinary conventional jackup rig after the vessel V has installed the pontoon footings 41 and 42. It should also be noted that the modular structure which is left at the operating site could serve as a foundation for other more permanent structures. Similarly it does not require that the structure thereby supported be positioned above the surface of the water. Obviously the same method thus could be used to install a storage tank or other underwater structure such as for example as the cylindrical tank 54 shown in FIG. 24 supported on pontoon footings 55 and 56 and likewise any such structure could be installed at the water surface (FIG. 25) or at some height thereabove (FIG. 26). Thus all of the FIGS. 23–26 illustrate that the vessel V may be operated without the mineral exploration apparatus and so may serve primarily as a construction machine for the building of various facilities offshore, both underwater and above.

Figure 27:
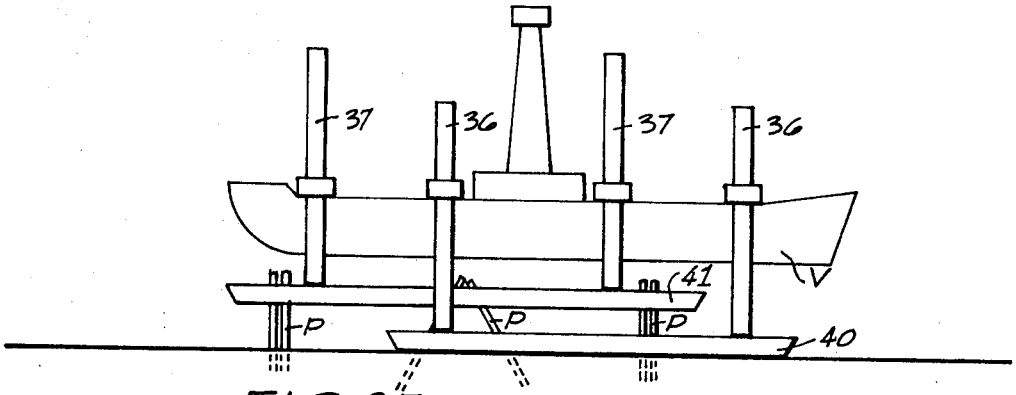

FIG. 27 is a side view of the vessel V in a position intermediate between the steps of FIGS. 8 and 9, with the piles driven, but the vessel V not raised. It serves to clarify the fore and aft disposition of the parts.

Figure 28:
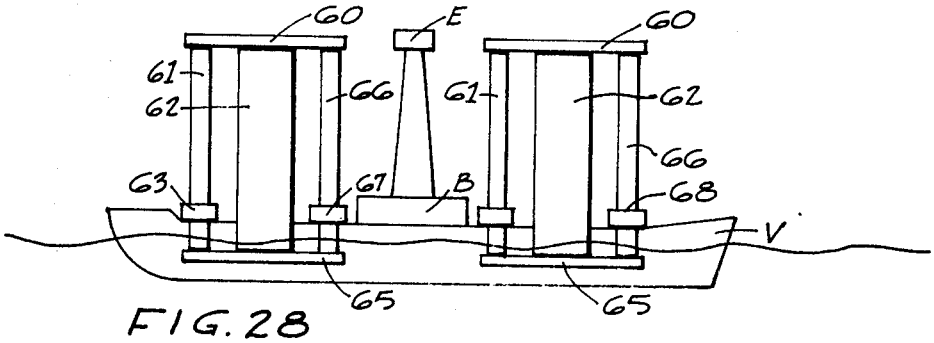
Figure 29:
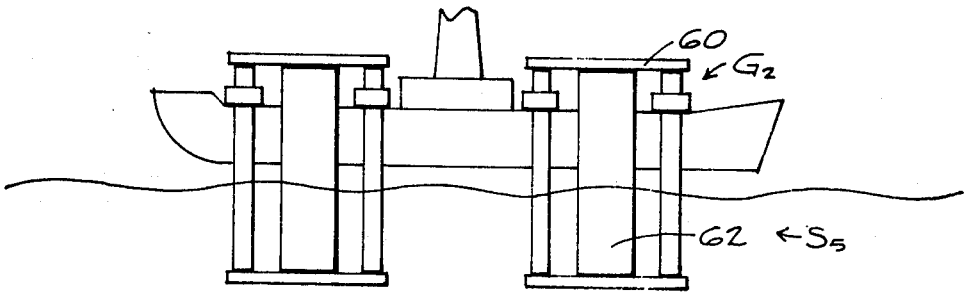

With reference now to FIGS. 28–30 there is shown a further modification of the apparatus of the prior disclosure in which the jacking module or legs are placed in legwells or couplings that connect the jacking module to the jackholder. However, the legs are new legs, that is replacements for ones previously left behind for repair or the like. The new legs are coupled with deck-like coupling members 60 and 65 to the support structures 62, the latter also herein referred to as station modules, which in the present instance are bottles. Thus the vessel V has been transformed into a jackup with bottom legs. The bottle structures are each adapted to linearly move in a vertical manner. Mobility is imparted to the vessel by elevating the bottles so that the vessel hull only is exposed to the water. FIG. 29 illustrates the reason for the transformation. The apparatus $G_2$ (generally comprising the spacing-jack-and-coupling-means) displaces the bottles or station module 62 and structure $S_5$ comprising elements 62 and 65 downwardly, thereby urging module 62 into the water and the vessel into the air. In this way it is readily seen that the jackup has been converted to a semi-submersible and it is thus less vulnerable to external forces because of wave transparency, thereby enabling reliable operation in deeper waters. FIG. 30 simply shows a front view of FIG. 29 thereby clearly illustrating the relative position of jackholder 67 and station modules 62 as the latter are displaced downwardly into the water. Bottle structures are shown in the prior art, e.g. "The Evolution of Offshore Mobile Drilling Units," R. J. Howe, Ocean Industry, 1966.

In all of the sequences of FIGS. 1–30 the vessel has remained substantially unchanged. The jackholder has housed jack means of a type commonly known except that heretofore there has been no reason to make the spudwells releasable. The vessel V has remained attached to the jackholder through the vessel coupling which is optionally permanent. Thus in all sequences shown, the structure of the jackholder has remained integral, in large measure with the vessel. In the views that follow, a new structure and somewhat modified vessel and means of operation will be discussed.

Figure 31:
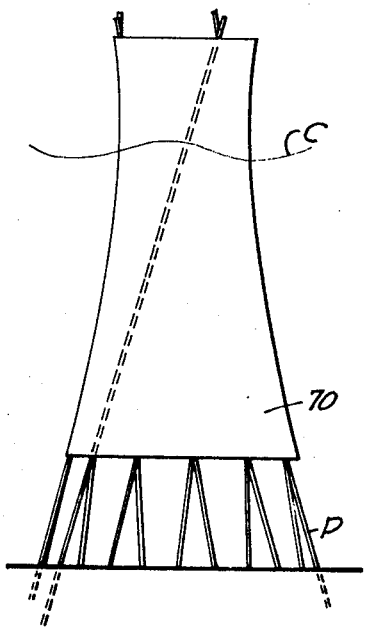
FIGS. 31–34 illustrate a modified structural station module for resistance to heavy lateral loading and which is adapted for obtaining lateral stability in uncertain, variable depths.

As introduction to the modified vessel, structure and method of operation, brief attention is directed to the drawing of FIG. 31 wherein there is shown a fixed platform of a type not generally known in the art. FIG. 31 is a rudimentary elongate structure 70 supported by a plurality of pairs of downwardly divergent piles P which most closely approach to one another proximate the water line C. This is done because the center of effort of lateral forces from wave action is at the water line and in order to reduce the resultant effect of those lateral forces the obstructing surface of a supported structure is designed with minimal area thereat. Thus FIG. 31, though illustrating a generalized and simplified form of structure intended only to describe the above principle, demonstrates a most advanced and effective platform or other structural support and whose strong relevance to the present invention will become apparent hereafter. Briefly it is pointed out, however, that the structure of FIG. 31 may consist of a hyperboloid of revolution of one sheet and which is characterized by its ability to spoil the oscillatory effects of waves, sometimes known as the Von-Karmann effects, and with the further quality, as briefly noted above, of presenting the least area of resistance in the zone of most lateral force. Rather than three pairs of divergent piles, the structure may consist of families of pairs of divergent piles, each family of which is disposed as rulings on a hyperboloid of revolution of one sheet, one ruled with clockwise downward progression, the other being ruled with downward counter clockwise progression. The two families form a generalized bipod when conjoined by the shell, and as a result one family resists shear on one face by tension, the other by compression. On the opposite face the role is reversed. The resultant structure is ideal and novel because of its capacity for containment of oil, especially spills, and also for its simplicity, high strength-to-weight ratio and also for employment of the structure 70 in the present invention and as now discussed.

Figure 32:
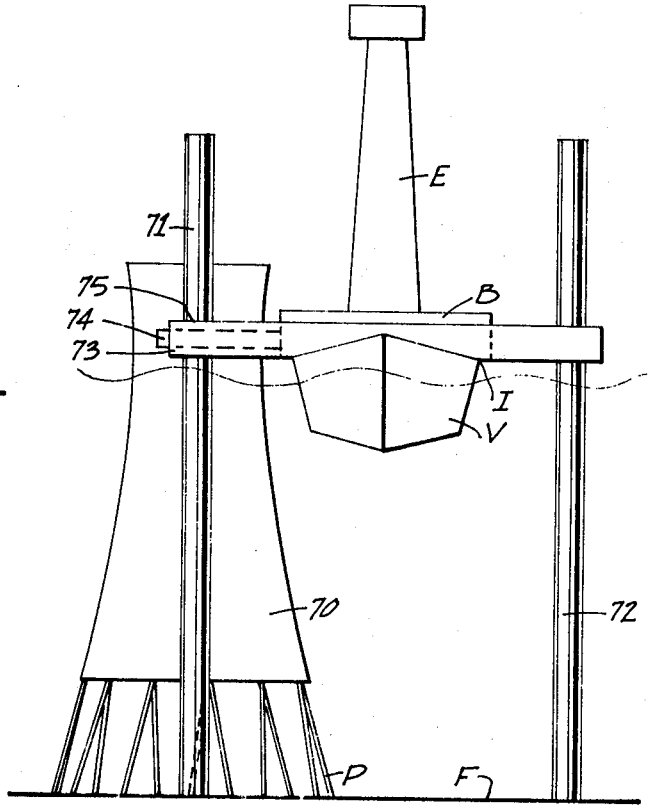
Figure 33:
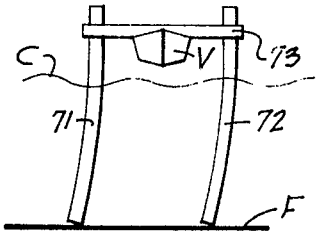
Figure 34:
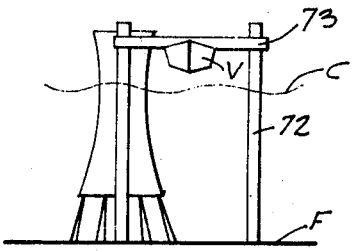

In FIG. 32 the fixed platform of FIG. 31 is used as a station module 70 and is shown in operational relationship with the vessel V which has jackholder 75 supported at one side by module 70 and at the other by jacking module (leg) 71. An exploration apparatus E is supported on a movable skid or base B on the deck of the vessel. The apparatus of FIG. 32 is in large measure analogous to the apparatus of FIG. 1 on these counts: 1) the module M and 70 respectively in each figure are disposed between the two holders H and 73 respectively, 2) the module M and 70 respectively stop short of the bottom and are supported by piles P extending from it through the water into the marine floor, and 3) the connector K and 74 respectively aid in the support of the vessel V. As may be seen in the analogous view of FIG. 34, the module 70 resides between the jacking modules 75 on one side of the vessel V. As illustrated in FIG. 33 the legs 71 and 72 generally tend to buckle laterally, but as FIG. 34 illustrates, the buckling will be resisted by the great lateral strength of module 70 transmitted through couplings 74, thereby allowing operation in deeper waters.

With reference now to FIGS. 35–42 there is shown a vessel V of the type described herein before. The function here is to provide a station module which can be quickly and surely placed and founded in hazardous waters and which is a primary source of lateral stability, while the vessel V obtains strength and stability mostly elsewhere, and particularly from the marine floor F.

Figure 35:
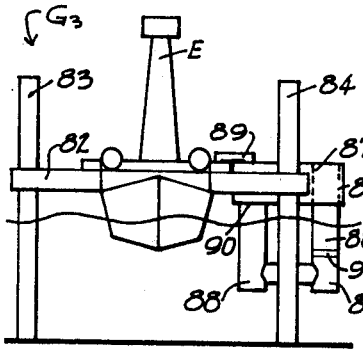
FIGS. 35–42 illustrate still additional means of obtaining lateral stability through use of the modular system while adapting to uncertain depths and hazardous waters.

The module disclosed in the sequence of figures beginning with FIG. 35 is particularly effective and useful in icy waters and in a wide range of depths. It comprises a vessel V with two jackholders 82 athwart and extending outboard thereof. The holders 82 hold jack legs 83 and 84 and leg wells 85 and 93 all very much as in FIG. 1. Newly introduced are releasable coupling winches 86 which couple the holders 82 to the vessel V. The module 79 comprises the deck 80 and a waterline module 81 having a waterline 93 thereon. The modules 80 and 81 have pile coupling sleeve means 87 and 88 respectively and coupling means 89 and weldments 90 for holding 80 to the vessel V and 81 to 80 thereby holding all of 79 to the vessel V. Spacing-jack-and-coupling-means $G_3$ comprises elements 82, 86, (85, 93) and (89, 90). Structure $S_6$ comprises module 79 (80, 81) and piles P. The rig E rests on the base B which serves to support E and 79 and unify $G_3$. The figures illustrate only one of the many operational sequences to which the apparatus is adapted. Certain possible variations and alternatives will be mentioned during the following description of that which is pictured.

Figure 36:
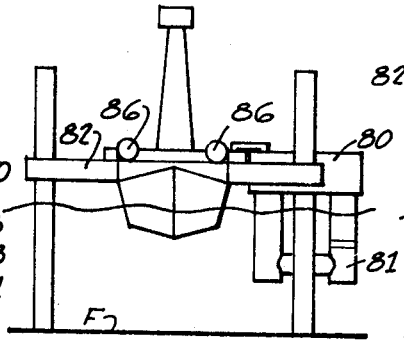
Figure 37:
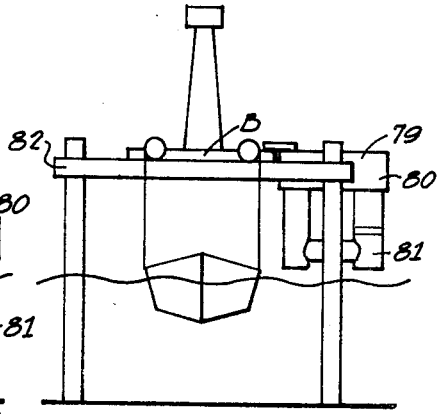

In FIG. 35 the rig has arrived and legs 83 and 84 have been planted on the marine floor by apparatus $G_3$. In FIG. 36 the cables of the winch 86 are parted from the vessel V leaving apparatus $G_3$ free of the vessel but leaving the base B coupled to jackholders 82. Next, the apparatus $G_3$ urges 82 and B upwards away from vessel V and thereby obtains the situation picture in FIG. 37.

The above sequence (FIGS. 35–41 and 42) varies from the previous sequences in that the apparatus $G_3$ is liberated from the vessel V which is herein never raised. It is, of course, possible to raise the vessel V just as before but these drawings show the alternative of not raising it thereby making vessel V free for other service. Another alternative would be to lower vessel V after raising it, this being an additional flexibility of operation introduced by the invention.

Figure 38:
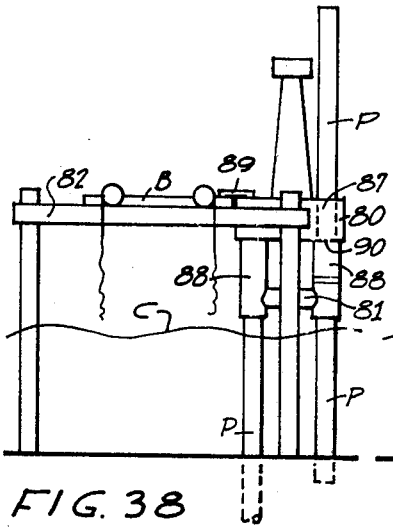
Figure 39:
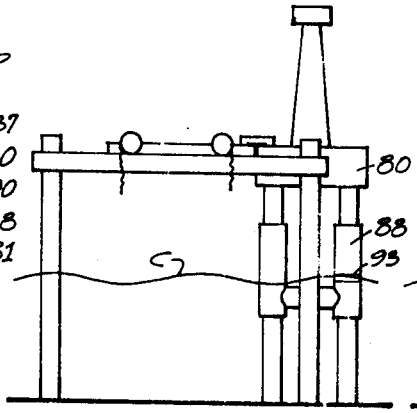
Figure 40:
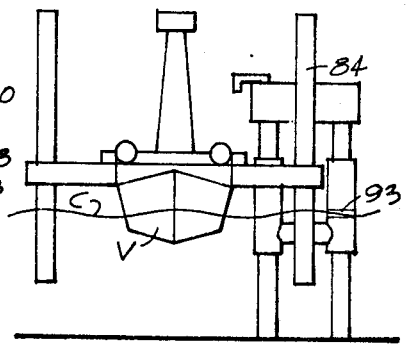
Figure 41:
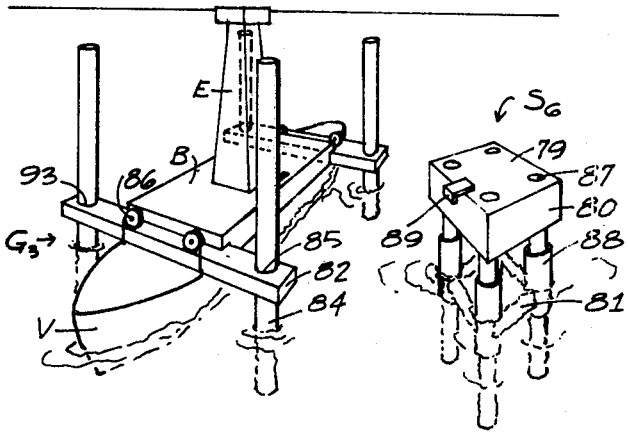

Continuing the pictured sequence, in FIG. 38 the piles P are passed through means 87, 88, and 91 of module 79 into the marine floor. Next the coupling 90 holding 81 to 80 is to be undone and rig E will be engaged by a cable to module 81 and the cable will be used to lower 81 to its waterline position shown in FIG. 39. In FIG. 39 the modules 80 and 81 are coupled, perhaps by grouting, preferably by welding as shown, by means 87 and 88 respectively to piles P whereupon the means $G_3$, the deck B, and the structure 79 are now seen to be formed into a unitary structural entity ready for work as an offshore station. In FIG. 40 the vessel is shown to have returned to retrieve the apparati $G_3$ and E. Just prior to the situation pictured, the vessel returned, means coupling 89 was undone and apparatus $G_3$ lowered itself and the exploration apparatus onto the vessel. An alternative possible sequence allowed would be to first elevate the vessel clear of the water into contact with jackholders 82 by means of winches 86, but in the pictured sequence the winches 86 serve only to hold the vessel V snugly against the jackholders 82.

Then next (in FIG. 41), the whole of vessel V and $G_3$ together depart the structure $S_6$ comprising station module 79 and piles P. Alternatively, E could be left behind on $S_6$ for later retrieval by the vessel V according to some sequence such as that just described. The preceeding discussion completes a description of the operation pictured in this sequence of FIGS. 35–41, however, comparison will be drawn to the apparatus of FIG. 1. It has already been noted that FIG. 1 lacks readily uncouplable means 86. This winch means 86 affords the advantage of allowing the vessel to depart the assembled structure, especially in case of a storm, but also in case the vessel is needed to bring cargo to the working site. The current pictured sequence did not picture the elevation of the vessel V to the level of the elevation of the structure 82 when the apparatus $G_3$ had lifted 82. Of course, in case it were necessary to go and bring other apparatus to the job, the vessel V would serve the purpose, however. The winches 86 could also do the duty of lifting other apparatus to the level of the structure 80 when the structure 80 was secured to the piles P as shown in FIG. 40. The pictured sequence is similar to FIG. 1 in that coupling means K and (89, 90) respectively holds the founded module M and 79 respectively to the vessel V and holds the vessel V to the founded module so that they interact as a unitary structure when subjected to severe lateral loads.

Examination of the nature of the structure $S_6$ comprising the module 79 with its piles P may now be made. First, no fixed platform of the prior art can be installed by a jackup rig with any degree of convenience. The novel concept of elevating and then lowering a part of the module 79 by securing it first to the vessel V and then releasing it from the vessel V and sliding it down piles P allows the structure to be adapted to a variety of conditions. In particular, it allows the deck 80 to be placed appropriately high above the water line C. In some waters, such as the Gulf of Mexico, a structure must be placed more than (50) feet clear of the water because waves of (50) feet in height can be anticipated. In such situations, the forces due to the waves are very high and the structure must be strong. However, in other waters such as Cook's Inlet, little variation is expected in the level of the water; therefore a convenient operating height can be selected for the platform somewhat closer to the water 20 than in the Gulf of Mexico. The lateral forces might be even greater in Cook's Inlet for they result from large masses of ice moving slowly against the platform. The closer coupling of the module 80 to the module 81 allowed by this invention might enhance the structural strenght of the station structure, whereas in the method of the prior art the structure is unitary and is not so adaptable to various heights. Another important point related to the waterline 93 on the module 81 so that it is at the level of the surface of the water that most of the corrosive and abrasive attacks on the structure 79 are made. It is also at that level that stairs and boat bumpers must be placed and it is there that moorings for mooring service vessels to the structure must be placed. In a structure of the prior art these things are decided once and for all, for they do not telescope in the manner disclosed. The preceding discussion relates to adaptability of the structure to various heights above the water. Similar comment is here made in regard to the depth of the water itself. Due to the fact that the module 79 can slide up and down the piles P, or to put it another way, due to the fact that the piles P may be of any lenght and still utilize the module 79, varying water depths are no obstacle to effective utilization. The module 79 would be well adapted for use in deep waters or shallow waters all because it does not reach the marine floor but is connected to the marine floor by piles, the lenght of which need not be determined when it is fabricated. The module 79 should be compared in this respect to the module M of FIG. 1. That module M does not reach the marine floor either and therefore shares novelty with the module 79 of FIG. 35. The difference is that the module M of FIG. 1 cannot be slid up and down its piles, for they are not parallel. Some advantages are attained by having them be not parallel, but certain disadvantages are obtained. In particular, the module cannot be slid along the piles so the module can in no way telescope. A structure such as that of FIG. 1 would not serve at all in icy waters. Its smaller and more numerous members would tend to collect ice and, as a consequence, would tend to be vulnerable more to bending and other stresses. The module 79 of FIGS. 35–41, however, is well adapted to icy waters because of the bulk of the means 87 and 88 and the structural arrangement thereof are sufficient to accommodate the piles P and are therefore more than strong enough to withstand lateral forces. The module 79 is likewise well adapted to resisting corrosion, such as by Monel cladding, since it has a waterline thereon and it is at the waterline that corrosion is mostly found, thus special precautions may be taken where they are most needed.

Figure 42:
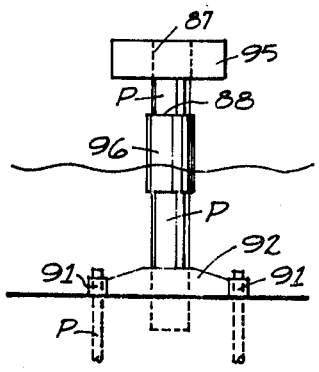

Still another novel concept is employed in FIG. 42 which will now be explained. Here there is a module element 95 comparable to the element 80 of FIG. 41. There is also a module 96 somewhat comparable to the module 81 of FIG. 41. And there is a module 92 which is new to FIG. 42, such module not being present in FIG. 41. Module 92 could have been provided on a four legged structure such as that of FIG. 41, but instead the sole leg modification is illustrated. Here there is additionally illustrated the concept of having a component mudline module 92. There are two classes of piles in the structure of FIG. 42 and each serves its distinct purpose. The structure comprises pile receiving means 87, 88 and 91 just as the structure of FIG. 41 comprised means 87 and 88. The method of installing the structure of FIG. 42 is directly comparable to the method explained with reference to FIGS. 35–41, with the addition of a module 92 which would be lowered along with module 96 to the depth to which 96 would be lowered and then would be lowered farther after the securing of 96 at its waterline location. The method of providing a mudline module 92 would have enhanced the structure of FIG. 35 in applications where the bottom was very soft or where the water was very deep. However, it should be realized that both methods can be employed either with a structure such as that of FIG. 41 or with a structure such as that of FIG. 42. The method of installation of the structure of FIG. 42 varies somewhat from the method of installation of the structure of FIGS. 35–41, however, with respect to the modules 95 and 96 the method is the same. The piles $P_1$ are comparable to the piles P of FIG. 41 and they are installed in the same way and means 88 and 87 likewise serve to support module 95 and 69 at their respective elevations at various depths in the installation procedure just as in FIGS. 35–41. The module 92 presents some difference, however. In the sequence of FIGS. 35–41 the module 92 was absent. In the sequence now to be discussed, the module 92 would be held against the module 81 by a coupling through 91 (not shown) at their meeting point. Then, when the $P_1$ was driven through 87 and 88, the piles $P_2$ through 91 would be driven all while the whole structure was telescoped together and held in a unitary whole against a deck B just like the deck of FIG. 41. The method of driving the piles might differ. For example, the piles $P_2$ might require some lateral support while they were being driven. For further example, it might be necessary to drive the piles $P_1$ into the soft mud and then to lower the module 92 for allowing some guidance for the piles $P_2$ by the module 92 lowered to its mudline position. Another opportunity is offered by the piles $P_1$. The piles $P_2$ are small and conventional in their character. The pile $P_1$ is very, very large and is not well adapted to being driven by conventional pile driving apparatus. However, the apparatus $G_3$ can serve to drive the pile $P_1$. The pile $P_1$ may be driven by securing it to the module 80 and then lowering the whole weight of the vessel V and the jackholders 82 and the module 80 and all of the other apparatus carried onto the pile $P_1$ thereby driving it a few feet into a soft bottom. The details of the sequence for installing the piles $P_1$ and $P_2$ are self evident upon comparison of FIGS. 35–41. The structural action of the structure 25 of FIG. 42 is quite different, however, and will now be discussed. The pile $P_1$ is very large in its diameter and as a result of its large size cannot be driven far into the mud; however, an advantage is obtained. The pile $P_1$ is very large in diameter and is necessarily large because it is the only element resisting lateral loads above the level of the mudline module 92 and must be capable of resisting great bending effects. But its size also tends to key the structure into the marine floor thereby resisting the lateral loads that result from above. The lateral shears will be absorbed by the pile $P_1$ and transmitted directly into the mud thereby eliminating lateral forces on the piles $P_2$ which are now seen to be provided principally to resist tensile and compressive forces resulting from overturning tendencies mentioned above although, of course, the piles $P_2$ could, in situations where it was warranted by the sub-surface conditions, be designated to carry the whole of the vertical load. This latter condition would be obtained when the soil was quite strong at a depth of, say, 50 feet below the mud but where the mud itself was very, very soft making it not possible for the module 92 to support the weight of the structure in bearing and not possible for the pile $P_1$ to support it by any means whatever.

Figure 43:
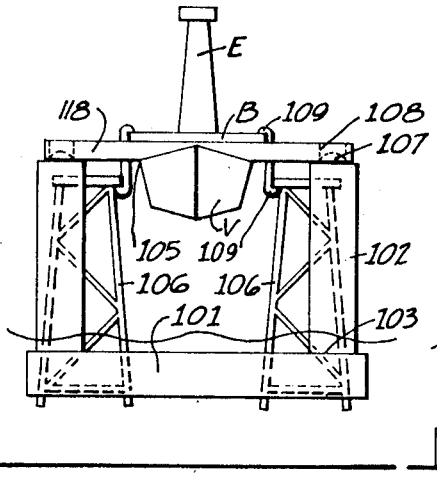
FIGS. 43–51 illustrate a variety of leg systems, both tensile and compressive, and a variety of isolating couplings all employed in a jackup semi-submersible of the modular type disclosed herein.
Figure 44:
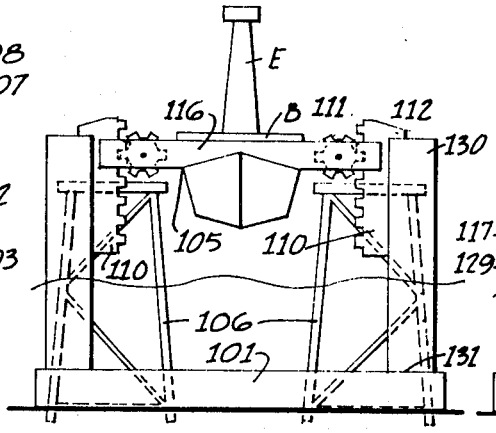
Figure 45:
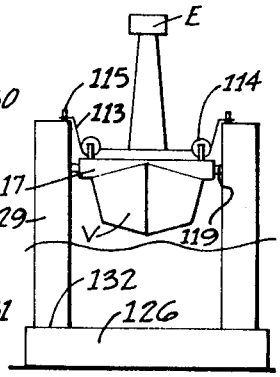

FIGS. 43–51 are closely related although FIGS. 43, 44 and 45 all picture different apparatus and the FIGS. 46–51 picture the same apparatus in a sequence of operations. All of the drawings, FIGS. 43–51, illustrate a station module in the form of mat serving to support the weight of apparatus by bearing on the marine floor and coupled to the mat there is a bottle which is held by welds. All of them also illustrate a jackup vessel V held to jackholders by means 105. The means 105 pictured herein are welds and are not meant to be readily releasable and thereby differ from the just preceding figures. Differences in the nine subject figures include the jack means and the coupling means which are different in various figures. Other differences include modules 106 which appear only in FIGS. 43 and 44 although variations could be provided wherein modules 106 would appear in figures similar to those of FIGS. 41–51.

First the structure of FIG. 43 will be discussed. In FIG. 43 there is the aforementioned mat 101 and the leg 102 all coupled into a submersible bottle-type transparent frame similar to submersibles of the prior art. A significant difference is the lugs 107 on top of the bottle structure 102. The lugs 107 are engaged in wells 108. The wells 108 are adapted to receive jacks in the future if it be desired to place them there; however, at present the wells 108 are adapted to receive only the lugs 107. The wells 108 are in the ends of members 104 just as leg wells have appeared in jackholder modules in numerous previous figures. Weld 105 couples the vessel V to the member 104. In the figure, the welds 105 support the weight of the vessel which hangs from the member 104 and which is itself supported on the bottle 102 and partly supported by the buoyance of the mat 101. Apparatus A is shown on the decks of the vessel. There are four bottles 102. To the right of the figure there are two, one obscured by the other. Between the two legs 102 there is a module 106 which is a pile jacket much like the pile jackets of the prior art. The module 101 is H shaped thereby allowing the pile jacket 106 to project between the two right bars of the H. The module 106 is held to the vessel V by a hanger 109 which rests on the base B which itself rests on the vessel V between the two jackholders 104, one at the front and one at the rear of the vessel. It can be seen from looking at the figure that by removal of the module 101 together with the bottles 102 in the vessel V with its structure H could be immediately converted into a jackup such as the jackup of FIG. 1 simply by installing jacks in the wells 108 and by inserting legs such as the legs L of FIG. 1 therethrough. And, of course, this is what is anticipated by having the configuration of FIG. 43 be so similar to the configuration of FIG. 1. Thus an advantage of the invention is illustrated, that being a vessel which can be quite readily converted from a submersible such as the submersible shown in FIG. 43 to a jackup such as the jackup of FIG. 1. Now that the structure has been described, the method of operation of the structure will be explained more fully.

FIG. 43 illustrates the apparatus in transit from one site to another at sea. Other methods of transit would be available for progress through deeper water. The submersible structure 101 and 102 together could be lowered further into the water and the vessel V could be buoyed up by the water by the buoyancy of its own hull. However, in FIG. 43, the vessel and station module 101 are shown traversing shallow water and being operated much as is a submersible of the prior art, with an exception, that submersibles of the prior art, with an exception, that submersibles of the prior art do not carry separable modules 106. Upon arrival at a site the structure comprising 101 and 102 together would be ballasted whereupon module 101 would sink to the bottom still holding vessel V clear of the waves and of the water. Then drilling activities could commence with the apparatus E and if a well were found then a well protecting module 106, which can serve to hold production apparatus as well, could be left behind to protect the well and to support the production apparatus to be associated with the well in the future. The module 106 would be installed by driving piles through the legs thereof just as is a pile jacket of the prior art. Until it may be determined to leave one of the modules 106 behind, they would remain bound just as they are now bound by coupling means 109 to the vessel V. Upon determining that one was to be left behind, piles could be driven through the legs of the selected module 106 and therefore convert it to a pile-supported pile jacket. Alternatively, the couplings 109 could remain coupling the module 106 to the vessel V and piles could be driven through some or through all of the legs of the module 106 to provide resistance against drifting of the whole on soft bottoms. Submersibles have been blown far from their working sites during a storm. This provides novel means of preventing the destruction of wells and the pollution of the water thereby and the prevention of loss of rigs in a storm. However, this is an optional feature and need not be employed in the operation of the apparatus of FIG. 43. Upon the completion of such a well and the releasing of the element 109 from the module 106, the structure could be de-ballasted, thereby refloating the whole and freeing all of it but the module 106 from the marine floor, thereby leaving the module 106 to serve, as for well protecting purposes. The structure of FIG. 44 is very much the same as the structure of FIG. 43 with the exception that a new and valuable element in the form of leg 110 is added. The leg 110 might better be called a grapple or "tensile leg" and will hereafter be so specified. The tensile leg 110 hangs from its toes 112 on the column 130. The tensile leg 110 has gear teeth cut in it and is, therefore, a rack that is engaged in a spur gear 111. 111 is built into the jackholders 116 and is a jacking means for moving the leg 110 up and down with respect to the jackholder 116. Jackholder 116 is, as in the other figures, coupled to the vessel V by means 105. The vessel V supports apparatus E just as before. Modules 106 hang between the members 104 just as in FIG. 43. There are legs which are themselves bottles 130 held by means 103 to a mat 101 just as in FIG. 43. The modules 106 could be installed precisely according to the same practice as could the modules 106 of FIG. 43 and therefore the practice will not further be discussed. However, new advantages are obtained by the tensile legs 110 as will now be discussed. It was mentioned when discussing FIG. 43 that legs could be installed in the leg wells 108 of FIG. 43. In this FIG. 44 it is not possible to do this, and therefore FIG. 44 is different from FIG. 43 in that respect. However, certain advantages appear with the tensile legs 110 because the vessel V is more readily releasable from the structure comprising mat 101 and bottle legs 130 because if the structure were to be sunk, then the vessel V would remain buoyant because the legs 110 would become disengaged from the legs 130 because the toes 112 would be brought out of touch with the legs 130. So that not only can the apparatus of FIG. 44 be operated just as can the apparatus of FIG. 43, but the vessel V can be made free of the module 101 thereby allowing it to operate as a drill ship and thereby allowing the module 101 to be left behind at a well site for production purposes just as can the module 106 be readily left behind at a well site for production purposes. The module 101 is particularly well adapted for some production purposes at shallow sites far offshore because the module 101 provides a natural means for storing petroleum therein due to its large bulk and due to its hollowness. It will be obvious to those skilled in the art that means are at hand to convert the structure comprising module 101 and 103 connected by means 132 to production purposes. After the separation is made between the vessel V and the structure of 101 and 130, the vessel V may operate as a drill ship. Alternatively, tubular elements could be bound to the legs 110 and could engage the toes 112 thereby allowing the said tubular elements to act as legs for a jackup so that the vessel V could then be operated simply as a jackup of the prior art. However, many alternatives are pictured elsewhere and will not be further pursued with respect to FIG. 44.

FIG. 45 is directly comparable to FIG. 44 in that there is also a tensile leg 113. However, in FIG. 45 the tensile leg 113 consists of a cable wound on a winch 114 so that 114 is also different from 111 of FIG. 44, which was a spur gear. 115 in this case is a tie of the cable to the leg 129 which is directly comparable to the leg 102 held by means 103 to a mat 101 in FIG. 44. The jackholder 117 resembles neither the jackholder 116 of FIG. 44 nor 118 of FIG. 43 except in that it is a jackholder and does lie athwart the vessel just as in FIG. 1, because it neither has a leg well in it nor does it have a spur gear; it has only a winch at its ends. Another new element of FIG. 45 is the bumper 119 which tends to absorb shock between legs 102 and the jackholders 117 therefore isolating the vessel V somewhat from the effects of shocks on the structure 126 and 129. This is an important element of the invention which appears here in rudimentary form but will be discussed in greater detail with respect to FIGS. 46–51 where its utility is more apparent. The structure of FIG. 45 is operable just precisely as is the structure of FIG. 44 and therefore the sequence of operations will not be discussed. Comparison between the FIGS. 43, 44, and 45 shows many common elements. The mat 126 of FIG. 45 might very well be provided with slots therein thereby making it H-shaped just as are the mats of FIG. 43 and FIG. 44, however, this is not shown in the view. FIG. 45 is a very rudimentary form of what would be called a tensile leg or perhaps called a legless jackup. The term footless jackup should properly be applied to any jackup whose jacking legs do not reach and bear on the marine floor but which rather bear on or reach a station structure provided for support of the jackup and for other purposes. The term legless jackup should be applied to any jackup whose jacking legs are rudimentary or fully separable therefrom.

Figure 46:
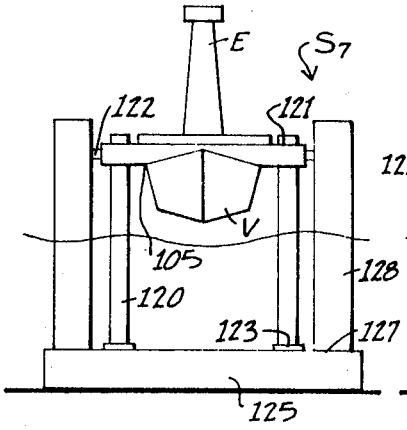
Figure 47:
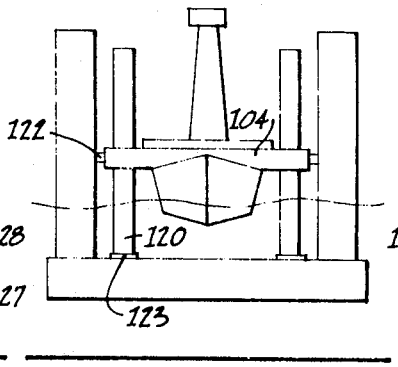
Figure 48:
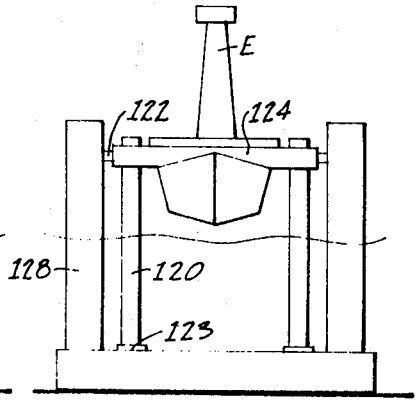
Figure 49:
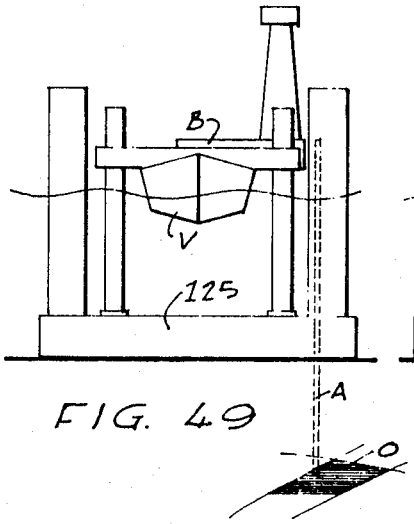
Figure 50:
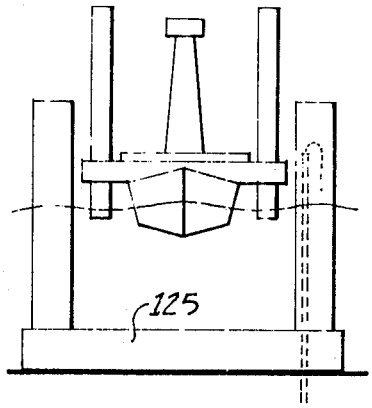
Figure 51:
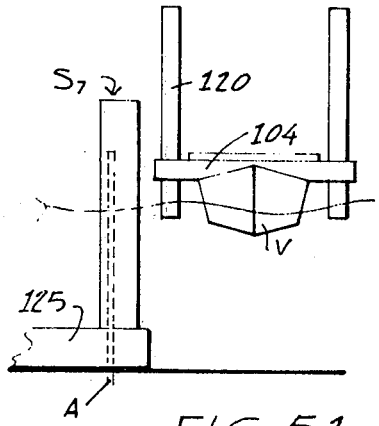

With reference now to FIGS. 46–51 there is shown a vessel V and jackholders with legs 120 extending through leg wells 121 just as in FIG. 1. Here there appears apparatus E on the decks of the vessel V. Distinguishing structure appears in the form of mat with a coupling 103 holding bottles 102 to the said mat 125, the whole forming a structure which will be understood to comprise the four bottles 102, the coupling 103 and the mat 125 together. There is a coupling 123 which is simply a hearing support or pad at the bottom of the legs 120 with provision for hooking the legs to the mat 125. The coupling 123 transfers the weight of the vessel V to the module 125 in the picture. There is also a coupling 122 similar to the coupling 119 of FIG. 45. In these drawings, the function of the coupling 122 will be more apparent in that it tends also to act as a shock absorbing flexible coupling. The apparatus of FIGS. 46–51 can be operated according to the teachings of FIGS. 44 and 45 except that the legs are not tensile but instead compressive, when the mat 125 is bottom supported, but they might become tensile when operated as in FIG. 47. In such case the structure V along with the jackholders 124 and legs 120 can be operated precisely as is a jackup of the prior art without any cooperation whatever between a structure such as the structure $S_7$ comprising elements 125 and 128. It should be recognized that this is an advantage of the present invention. However, the sequence to be discussed will show the jackup vessel V being operated as a novel submersible. The sequence of operations is as follows. FIG. 46 shows the jackup vessel V having been raised by the jacking apparatus onto the legs 120. The vessel V is clear of the water and the whole is in working condition and in working position. However, the operation pictured is not working but rather the mating of the vessel V with the structure comprising elements 125 and 128. Vessel V has just arrived and has placed itself in working relation to the submerged structure. Couplings 123 are completed thereby allowing de-ballasting of the submerged structure comprising elements 125 and 128 with lifting effort through the legs 120 if necessary thereby allowing the position of FIG. 47 to be obtained. The position of FIG. 47 is the traveling configuration. The apparatus proceeds to a site. The structure is ballasted. The legs 120 are extended farther below the vessel. The jacking apparatus urges the structure comprising elements 125 and 128 to the bottom and thereafter urges the vessel V into the air just as is shown in FIG. 48. In FIG. 48 the whole is placed at a working site. In FIG. 49 a well is being drilled and has been arranged to produce into the structure comprising elements 125 and 128. No details need be shown for this will be done in a manner obvious to those having ordinary skill in the art. Now, the vessel V and the apparatus A have done their work. They are free to leave the structure comprising elements 125 and 128 behind serving as a station structure to receive petroleum therein. Additional structure could be imposed upon the legs 128 to support production apparatus if such were desired. The vessel V departs as shown in FIG. 51 leaving the well producing into the submerged structure $S_7$. In FIG. 51 it can be seen that the vessel V could be operated just as the vessel V of FIG. 1 is operated. FIGS. 46–51 illustrate the considerable flexibility obtained by the present invention. Vessel V is available to operate as a drill ship or as a jackup or as a submersible, or as a semi-submersible. Thus can be seen an important advantage of the coupling 122. Not only does it insulate the vessel V from action of the structure $S_7$, it tends to support the vessel against lateral loads, and to relieve the slender legs 120 of the need to resist lateral loads.

It can also be seen that the same advantage obtains to all of the FIGS. 43–51. Large bending strength need not be provided to the legs. Indeed, bending strength in the legwells, so necessary on jackups of the prior art, is very little needed in the pictured apparatus, especially when the legs are tensile.

FIGS. 52–58 are a sequence illustrating the cooperation of two vessels, V and W, in a sequence of steps to build a large modular station offshore. The apparatus is similar to that of FIG. 1 in that there is a vessel V with jackholders H holding legs L in wells J therein with legs L supporting vessel V by bearing on the marine floor and in that there is a pile-supported station module M having pile guide means Q with piles P therethrough, and in that the jackholders H are held to the vessel V by coupling means I, and in that legs L run through coupling leg wells J in the ends of the means H, and in that module M is coupled to vessel V by a coupling sleeve K for bracing the vessel V with the structure S comprising M and P together. And the vessel W is likewise endowed with the same type of apparatus including spacing-jack-and-coupling-means G comprising means H, I, J, and K for spacing and re-spacing and coupling M and V. But many differences can be seen between FIG. 1 and the present sequence of FIG. 52. A first difference is in the multipartite nature of the station structure having fixed modules 136 and numerous modules 135 and in the plurality of vessels V and W employed for stationing the structure. A second important difference lies in the surrounding nature of the modules 136 which here in FIGS. 52–58 surround the legs 137 thereby bracing them symmetrically against buckling and overturning. A third important difference is seen in the couplings 138 which here are pillow blocks holding novel rotatable jackholders 139. A fourth operational difference is that the sequence applies to a large construction project, but this is only a difference in function and scale. Another important difference is that the coupling 140 is a sleeve through the deck of the module 136. The sequence of operations illustrated is as follows.

Figure 52:
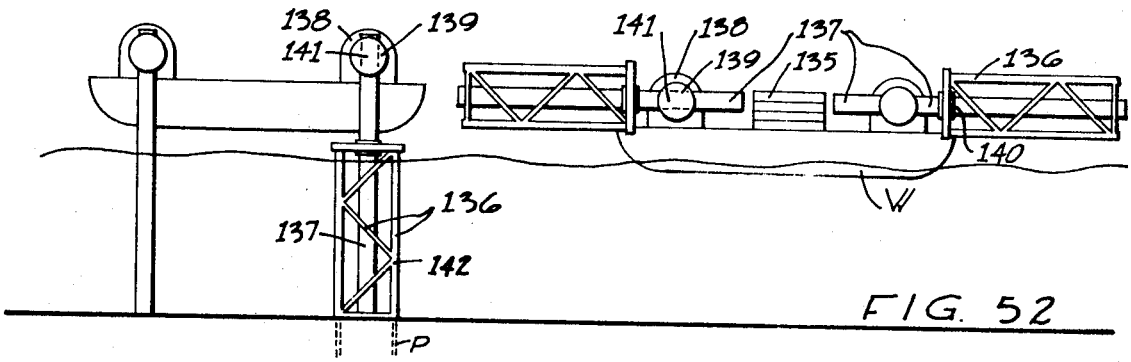
FIGS. 52–58 illustrate use of the modular system for construction purposes, for building large modular structures at sea, and illustrate rotatable leg means.
Figure 53:
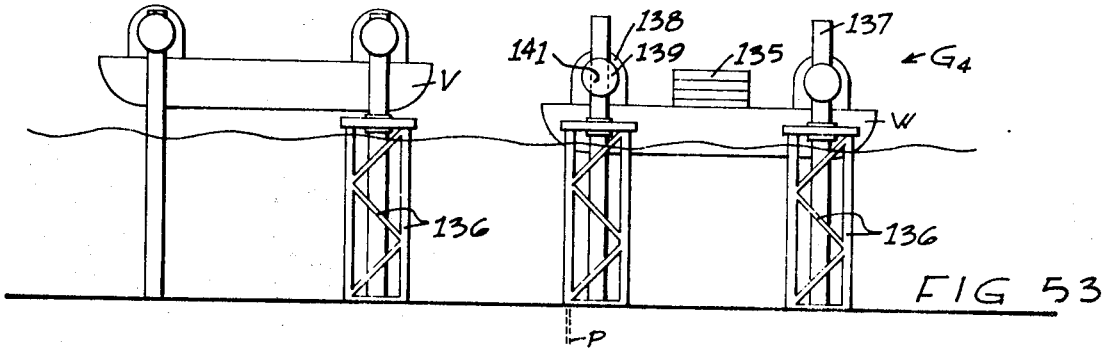
Figure 54:
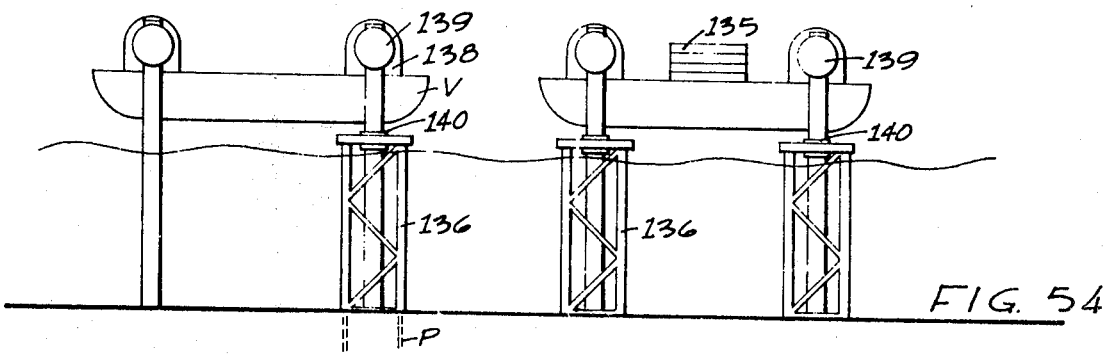
Figure 55:
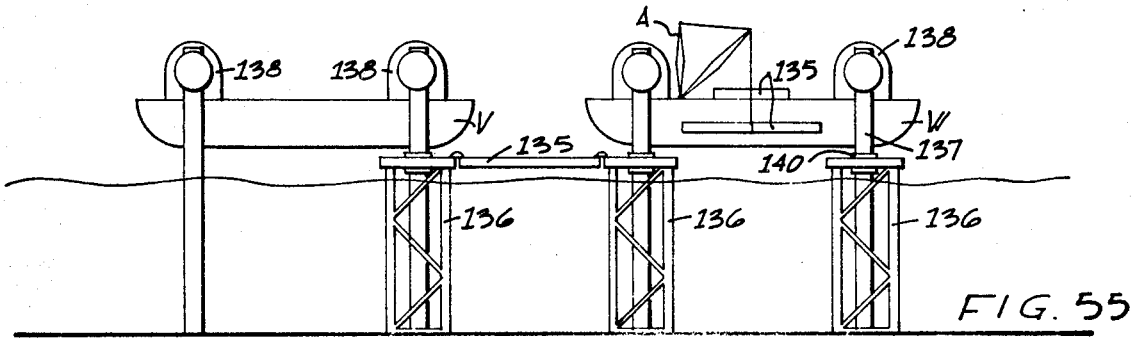
Figure 56:
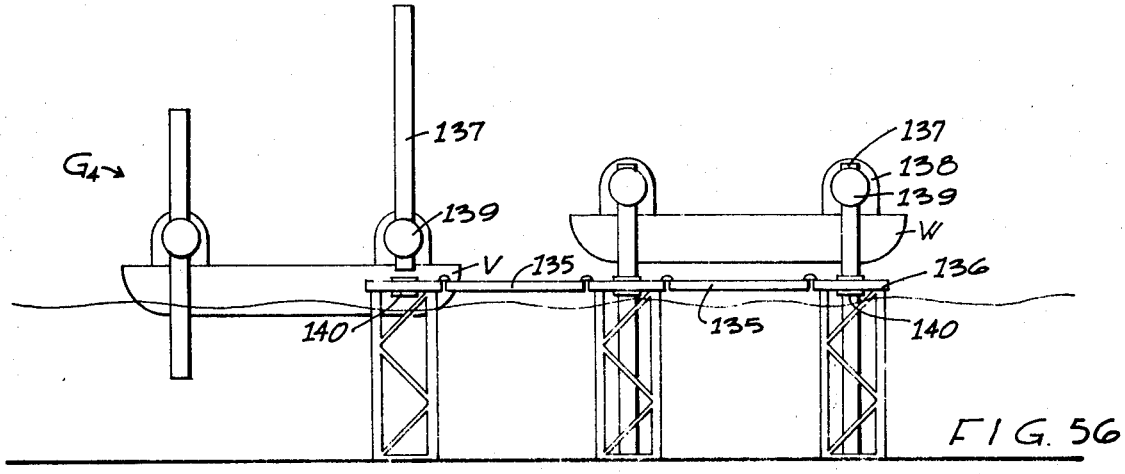

In FIG. 52 the vessel V is stationed on its legs 137, two of which are braced by means 140 to the previously founded station structure 136 which is supported by its piles P held, possibly by grout, or preferably by welding at the deck of the module 136, just as in the prior art. Of course, the prior art exhibits no such thing as a jackup leg extended through a pile jacket. In the same FIG. 52, there is a vessel W having identical apparatus 138, 139, 141 and 140 and four identical modules 136 wrapped around all four of the legs of the vessel W. On the deck of the vessel W are modules 135 whose purpose will be discerned and exhibited in later figures. A novel and very important feature of the apparatus of FIGS. 52–58 is illustrated by the vessel W. The jackholders 139 are rotatable in the means 138 which are partly releasable to allow rotation of the jackholders 139. When the jackholders 139 are rotated as shown on the vessel W in FIG. 52, they will hold the station module 136 and the legs 137 clear of the water therefore allowing speedy transit of the vessel W through the water. The vessel V and the jackholders 139 are shown in their other position wherein they support the vessel clear of the water with the legs vertical. FIG. 53 illustrates the turning of the jackholders 139 along with the apparatus that they carry which includes the legs 137 and the modules 136. In FIG. 53 the vessel W is still afloat and its weight is not yet borne up by the legs 137. The jacking of the apparatus $G_4$ has not yet begun. In FIG. 53 pile driving has been begun but is not yet complete. FIG. 54 illustrates the next step wherein the vessel W has been raised upon its legs 137 which are now braced by the fully founded modules 136. The piles P are all driven and are coupled to the modules 136 therefore providing a firm foundation for the said modules. The vessel W is now in the same condition as the vessel V except, of course, that the vessel V has only two modules M. Alternatively it could have had four, just as does the vessel W, but the two are pictured differently to illustrate possible variation. FIG. 55 illustrates additional work by the vessel W, which is primarily a construction vessel. FIG. 55 illustrates the completion of the elevation of vessel W and the commencement of the installation of modules 136 by the vessel W. Vessel V has completed its work which may have been the drilling of an oil well. It is now prepared to be lowered and to leave, allowing the vessel W to complete the bulk of the construction work. In FIG. 56 the vessel V is shown afloat. It has been returned to the water surface from the condition shown in FIG. 55. It was returned by the apparatus $G_4$ operating as a jackup jack. An important difference between usual jackup jacking and the operation shown by FIG. 56 is that in ordinary jackups the leg wells are not above the surface of the water as they are in this case and there is no module 136 surrounding the legs. The advantage of having the leg wells above the water is hereby illustrated, that the lower portions of the legs can be reached and made accessible for modification. The legs can be fully withdrawn from the water and fully withdrawn from the module 136 thereby allowing rotation of the legs, and separation from the module 136.

Figure 57:
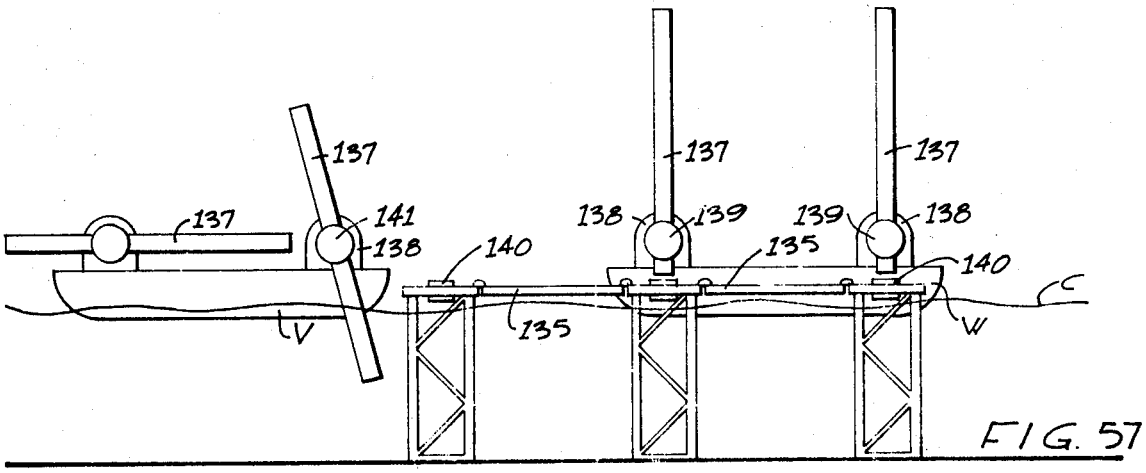
Figure 58:
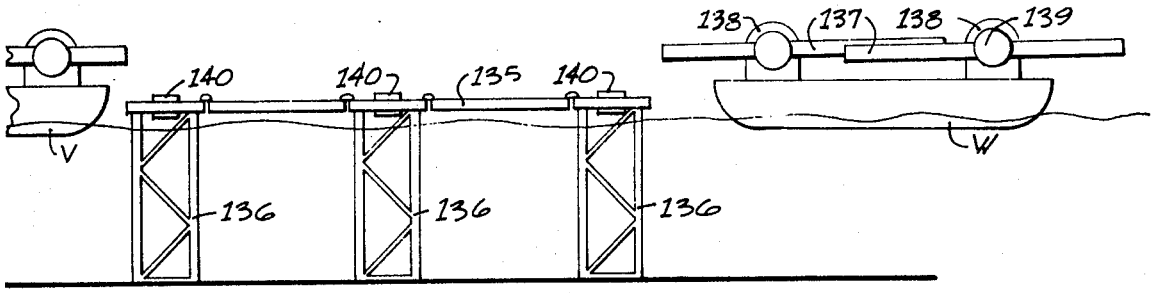

FIG. 57 illustrates the rotation of the apparatus 139 along with legs 137, in the means 138 to achieve streamlined condition of having the legs withdrawn from the water, which is not know in the prior art. The benefits of such an arrangement can be realized when it is known that numerous jackups have been lost due to the elevation of the center of gravity of their legs far above the deck and due also to the impediment of the legs and leg wells dragging through the water when the jackup is moved about while floating. Neither disadvantage is found in the vessel V with its legs rotated to the horizontal position. In FIG. 57 the vessel W is shown returned to the water and its legs are being withdrawn from the modules 136 which were installed by the vessel W. In FIG. 58 both vessels are shown departing in their streamlined traveling mode leaving the fully founded structure comprising six (6) modules 136 and numerous modules 135 hanging between the modules 136. In FIG. 58 it may be noted that the arrangement of the wells 141 in the apparatus 139 allows parallel laying of the legs. This is obtained by having the front legs be outboard of the rear legs or vice versa so that the legs 137 at the front of the vessel do not rotate in the same plane as the legs 137 at the back of the vessel W. Distinctions between the modules 136 of the figures just described, FIGS. 52–58, and the module M of FIG. 1 should be made. The module 136 of these figures is a pile jacket just as are pile jackets of the prior art. It has little to recommend itself over the jackets of the prior art. These figures illustrate that structures such as those of the prior art may be used interchangeably with the novel structures disclosed in this specification with the simple addition of coupling means 140. In these figures the coupling means 140 were introduced at the level of the decks of the modules 136. Numerous coupling means 140 for bracing the legs 137 might be introduced in very, very deep pile jackets. Alternatively, the legs 137 might never have reached the marine floor and might rest on other couplings 140 made structurally integral with the legs 137 might never have reached the marine floor and might rest on other couplings 140 made structurally integral with the module 136 thereby adapting such jackups as are illustrated in FIGS. 52–58 to very deep water. A tall slender pile jacket such as the modules 136 but longer would thereby adapt this jackup, which is capable of moving in very shallow water due to the rotatable nature of its legs, to very deep water. No such advantage is found in vessels of the prior art. The results are worthwhile to notice that the bending strenght required in the leg wells 141 is smaller than that required in leg wells of vessels of the prior art because the modules 136 absorb a part of the bending strength and the most important thing to the strength of the vessel then becomes the specific character of the module 136. The module 136 adapts the vessel V to work in shallow waters, just as other jackups with slender legs and weak leg wells might do, or adapts them to work in very deep waters which are not workable by vessels of the prior art which have slender legs and weak leg wells.

Figure 59:
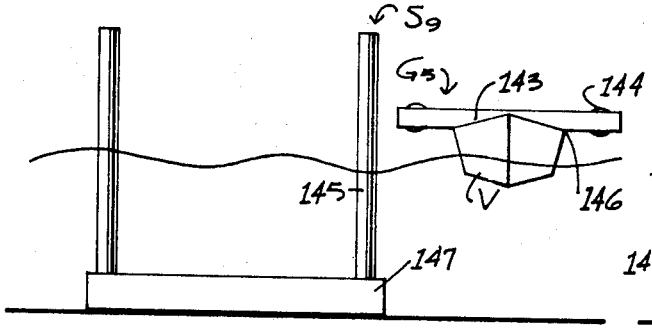
FIGS. 59–62 illustrate further application of tensile legs to mat type jackup structures of a modular system, the "legless jackup."
Figure 60:
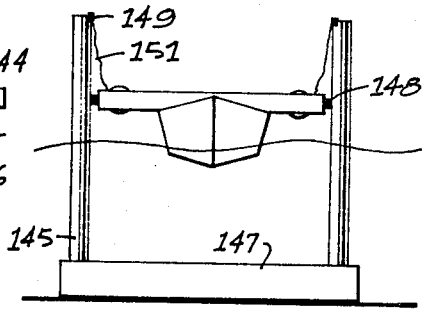
Figure 61:
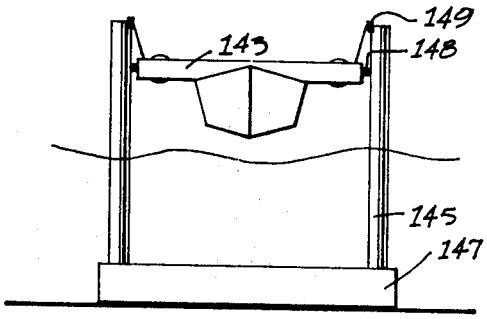
Figure 62:
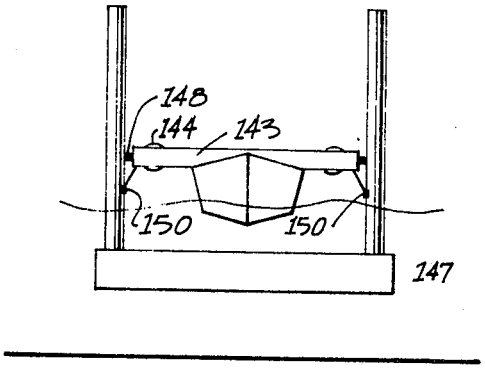

FIGS. 59–71 returns to the concept of the tensile leg. FIGS. 59–62 illustrate a mat type jackup structure. The apparatus of FIGS. 63–70, although it is illustrated to be resting on the marine floor, could be operated as a semi-submersible instead of a submersible as shown. Now that relationship is established between the FIGS. 59–71 by reason of the first four figures of the sequence, FIGS. 59–62, illustrate a tensile leg jackup having winches with the tensile cables 144 wound thereon. The winches are mounted in jackholders 143 just as other means have been mounted in other jackholders. The jackholders 143 are held by coupling means 146 to vessel V. Structures shown in FIG. 59 resting on the marine floor comprises a mat 147 and legs 145 coupled permanently thereto by welding. The tensile legs 151 comprising simple cables have at their upper ends couples or hooks for engaging the legs 145. The hooks are called 149. There is also a means 148, a bumper for spacing the module 143 away from the legs 145. Means 146 holding the coupling member 143 to the vessel V is a simple weld just as in FIG. 1. There is another coupling illustrated in FIG. 62 called 150. 150 is an alternatively used coupling which does not serve the precisely same purpose as the couplings 149 and the couplings 148. Each resists forces of a different character. Explanation of the sequence of operation of coupling means 149, 148, and 150 follows: In FIG. 59 the vessel V with its jacking apparatus approaches the module 147. In FIG. 60 the vessel V has been positioned between the legs 145 of the structure $S_9$ which comprises legs 145 and module 147 and the means 149 and 148 have been secured to the structure $S_9$. The means 149 is a simple hook and the means 149 is a flexible bumper. The bumper serves the purpose of isolation as it has served in previous figures. It will be noticed that the means 149 is capable only of exerting primarily vertical forces on the vessel V. The means 148 exerts primarily horizontal forces on the vessel V. The means 149 will support the weight of the vessel V on the legs 145. Means 150 to be discussed hereafter, will support the weight of the legs 145 by reason of the buoyance of the vessel V. In FIG. 60 the means 149 and 148 have been secured and the vessel is now ready to be elevated. In FIG. 61 the vessel is shown elevated after operation of the winches 144 having the tensile legs 151 wound thereon. The means 149 still supports the weight of the vessel and the means 148 still prevents lateral movement of the vessel V. Thus the apparatus and couplings prevent large bending stresses from being introduced into the vessel V by flexure of the legs 145 and the module 147 so that the character of the structure $S_9$ fully determines the structural resistance of the whole to lateral forces. In FIG. 62 the vessel V has been returned to the water by operation of the apparatus $G_5$ and the coupling 149 has been undone, but the coupling 148 has not been undone. The coupling 148 is still in sliding contact with the legs 145. Coupling 150 has now been employed; coupling 150 comprising simple holes in the legs 145 in which the hooks 149 have been engaged. The vessel V has, by means of the apparatus $G_5$, coupled to the legs 145 by the means 150 now picked up the mat from the marine floor just as mat type jackups always pick up the mats from the marine floor. It should be recognized, however, that it is not necessary for a mat to be employed with such apparatus. A mat type jackup is not the only structure that can be used in this way. Other such structures include submersibles 15 and semi-submersible bottle type devices such as will next be illustrated in the figures which follow hereafter.

Figure 63:
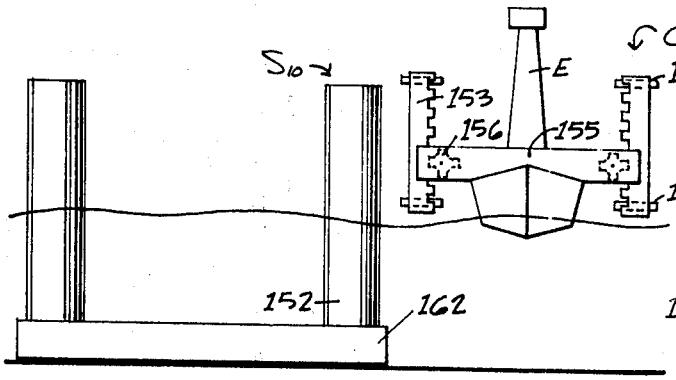
FIGS. 63–69 illustrate the legless jackup with submersible-type structure.
Figure 64:
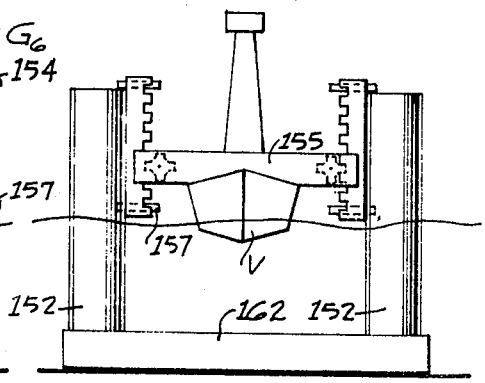
Figure 65:
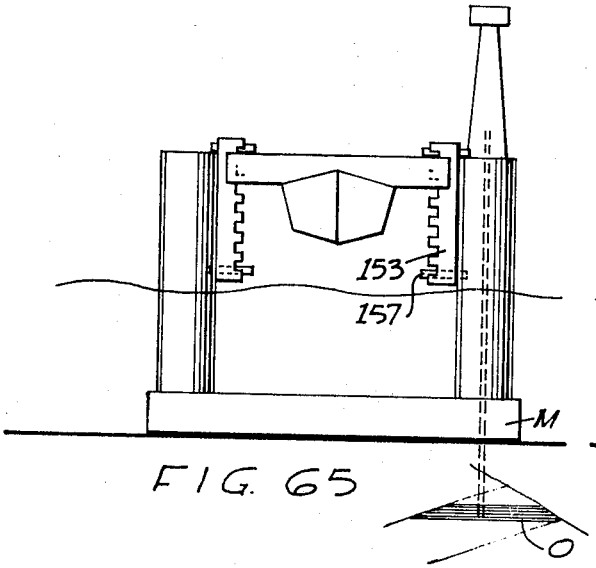
Figure 66:
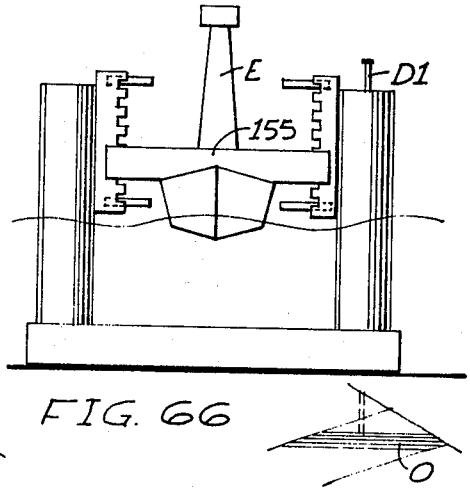
Figure 67:
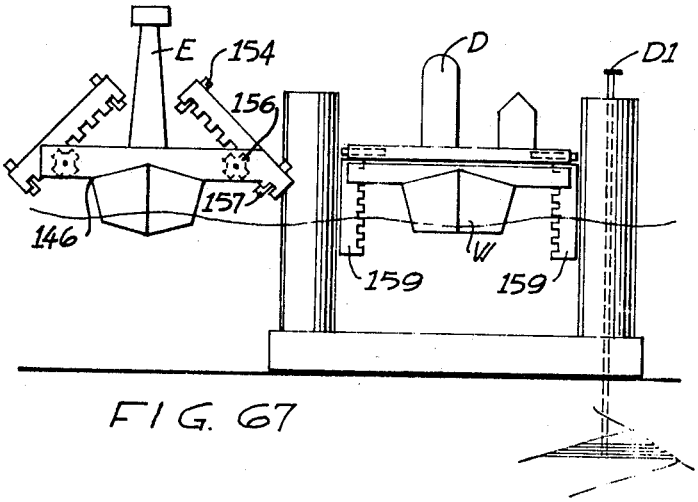
Figure 68:
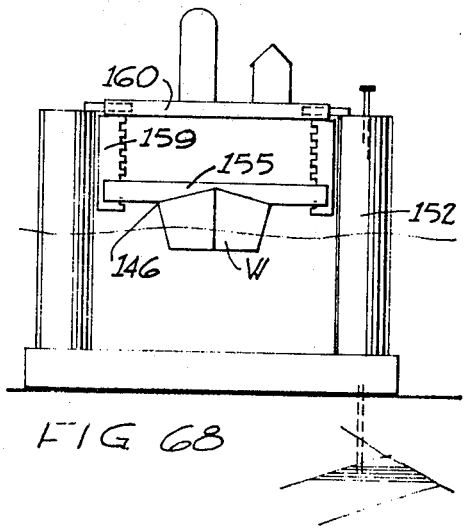
Figure 69:
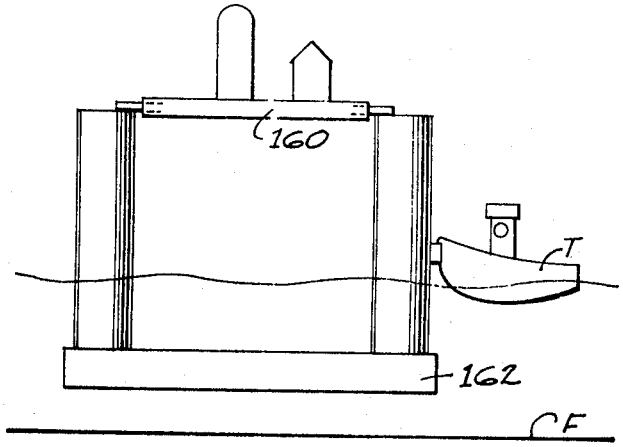

FIGS. 63 and 64, 65 and 66 illustrate similar operations with a tensile leg in a submersible bottle type frame. First the structure will be described. As can be most clearly seen in FIG. 63 there is shown a vessel V with jackholders 155 (two) athwart the decks of the vessel V. There is apparatus E for drilling wells. There is a toothed rack leg 153 which serves as a tensile leg just as the cable 151 in the preceding figures. The leg 153 has pin 154 at its top and 157 at its bottom. The teeth on the inboard face of the legs 153 engage a gear 156 which serves to couple the weight transmitted through the leg 153 into the jackholder 155 and 156 is therefore a movable coupling means. The member 155 lies at the deck B and is secured by means 146 to the vessel V just as before. The structure $S_{10}$ comprises the mat 162 and the legs 152 which are here bottles and serve to make a buoyant wave transparent frame of the structure $S_{10}$. The structure has now been described. The operation will now be described. In FIG. 63 the vessel approaches the structure $S_{10}$ just as the vessel approached the structure of FIG. 59. The structural differences have been noted. In FIG. 64 the vessel V has been positioned between the bottles 152 and the pins 154 have been rested onto the tops of the bottles 152. The pins 157 have been inserted into holes in the legs 152. The vessel is ready to lift the structure $S_{10}$ if it should choose to do so. However, that is not the operation illustrated. In FIG. 65 the vessel has lifted itself by means of the apparatus $G_6$ to a position clear of the water and is in position to shift the apparatus E outboard for drilling through the mat 162 into the marine floor to find oil. FIG. 66 shows the vessel having completed its work and now leaving. It has returned itself by means of the apparatus $G_6$ to the marine floor and the pins 154 and 157 have been withdrawn from engagement with the legs 152. The bottle structure $S_{10}$ will be left behind as a production facility just as the structures have been left behind in previous figures. In FIG. 67 the vessel V departs. It should be noted that the legs 153, the tensile toothed legs, can be rotated to a horizontal position thereby obtaining some of the advantages of rotatable legs which were mentioned with respect to the FIGS. 52–58. It is also illustrated in FIG. 67 that another jackup which is similar to the jackup which is now leaving the structure $S_{10}$ has positioned itself between the legs 152. This jackup is not an exploration jackup but rather a production jackup. It carries apparatus on its decks for producing oil from the well that has been drilled $D_1$. The structure of the production jackup with vessel W is different than vessel V in respect that the geared legs 159 are used for a different purpose from the purpose which has previously been illustrated. The geared legs 159 are used for raising devices and supplies for production purposes to the top of the legs 152 without ever elevating the vessel W. The vessel V was lifted as a whole. The vessel W is not shown to be lifted at all although it is capable of lifting itself, using legs 159 just as vessel V used legs 153. The sequence of drawings does not illustrate the lifting of the vessel W. Rather it shows that the legs 159 could be operated not as tensile legs but rather as compressive ones and serve to elevate a module 160 to engagement by means of pins 158 and the legs 152. The legs 159 which are geared just as are the legs 153 on the vessel V support the deck 160 having apparatus D thereon. The legs 159 are engaged by a spur gear similar to the spur gear on the vessel V. The spur gear here serves to drive the legs upward, supporting the weight of the apparatus $A_2$ and the elements 160. FIG. 69 illustrates a much later stage in the development. The vessel W has since departed. Now the structure $S_{10}$ is being moved to another location by virtue of its semi-submersible buoyant character. It has been buoyed up by de-ballasting and is being pushed by the tugboat T. One can hope that in the usual operation the vessel W could depart promptly after bringing the module 160 and that the structure would remain in place for years to produce petroleum O. The vessel W was used strictly for delivery purposes although it is fully capable of operation just as was the vessel V in FIGS. 63, 64, 65 and the like.

Figure 70:
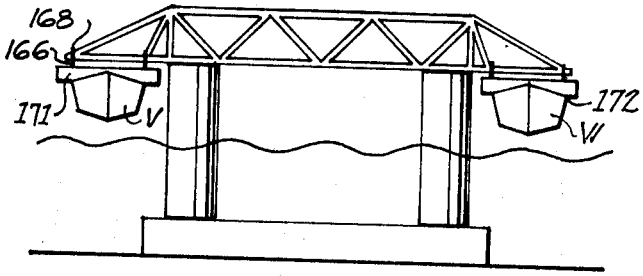
FIGS. 70–71 illustrate the use of multiple vessels on individual structures of the modular system.
Figure 71:
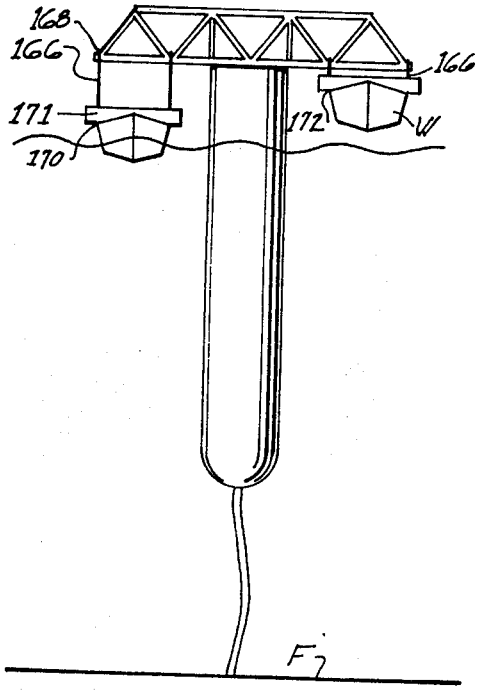

FIG. 70 differs primarily in relative size from the previous structure. In FIG. 70 the apparatus is a much larger bottle structure and is capable of supporting more than one vessel V at a time. The previous figures, such as FIG. 67, showed two vessels, a vessel V and a vessel W, each supported on the structure but not at the same time. In FIG. 70 it is illustrated that the vessels might be there at the same time, one of them drilling and the other one performing production or delivery service. The structure of FIG. 70 comprises a station module 163 with legs 164 thereon supporting an upper structure 165 which in turn supports tensile legs 166 in fashion similar to that pictured in the preceding figures. FIG. 71 shows the similar concept but in which there is only one bottle 167, a needle-type bottle with ballast in its bottom that causes it to float erect as pictured. This is suitable for very deep water. More than one vessel, a vessel V and a vessel W, are both supported from the top of the structure by hooks 168 on the ends of tensile legs 166 going to winches 170 held in the ends of jackholders 171 which are coupled to the vessel V by means 172, all just as before. The preceding sequences beginning with FIG. 59 and ending with FIG. 71 all illustrated various forms of structures employing legs that are tensile in nature. The FIGS. 69, 70, and 71 illustrate that great variety of bottle type structures is contemplated by the invention. Numerous and varied bottle structures might be employed, and the drawings are to be considered to be only exemplary of the variety of structures.

Figure 72:
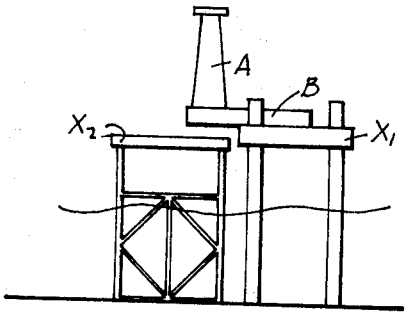
FIGS. 72–77 illustrate first of all a prior art approach in which a jackup operates independently of other structures; and in which there is subsequently shown the modular system of the invention in which increased economy is produced without reduction in stability.
Figure 73:
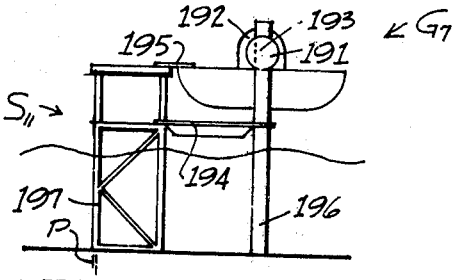
Figure 74:
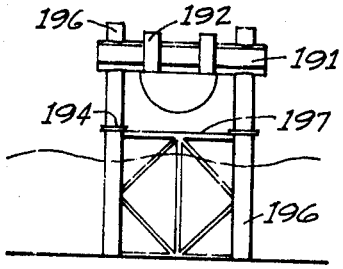

Now another modified form of structure will be shown. FIGS. 72–77 relate to workover jackups. In the prior art it is common to have a stationary structure, a pile jacket, with apparatus thereon for producing oil through wells that have been drilled through the pile jacket. A jackup will approach such a structure carrying a rig. The rig supported on the jackup will then work the wells over when they become clogged, for example. Jackups of the prior art are independent of the structures which support the wells. FIG. 72 shows such apparatus. There is a jackup $X_1$ which supports a base B cantilevered over a structure $X_2$, holding apparatus A above it. The present invention envisions structural cooperations between a fixed structure and a jackup, as will now be shown. The apparatus of FIGS. 73 and 74 will now be described. It comprises a vessel V, spacing-jack-and-coupling-means comprising a jackholder 191, a pillow block 192, a pair of leg wells 193 in the ends of the jackholder 191 and couplings 194 and 195. Running through the leg wells 193 are two legs 196, one on each side of the vessel V. A coupling 195 is shown in FIG. 73 securing the vessel V to a structure $S_{11}$ comprising a pile jacket 197 with piles P therethrough. Now the operation illustrated by the two figures will be discussed. Prior to the situation pictured in FIG. 73 the vessel V was afloat and the legs 196 were horizontal just in the fashion of FIG. 58. The apparatus 191, 192, 193, and 196 is very similar to the comparable apparatus 139, 138, 141, and 137 of FIG. 58 on the vessel W. The vessel V then approached the structure $S_{11}$ and the legs were made vertical by rotation of the means 191 and the pillow blocks 192. Then the coupling 194 was placed at the bottom of the leg wells 193 by reliance on the beneficial clearance of the leg wells above the water and was engaged to the module 197 and to the legs 196 thereby bracing the legs 196 to the module 197. Then the apparatus $G_7$ elevated the vessel to the level of the deck of module 197. Coupling 195 was made fast, holding the vessel V to the deck of module 197. FIG. 74 is another view of the same apparatus. In FIG. 74 the vessel V is seen from the end. In FIG. 73 it is seen from the side. The advantages of such operation are in ecomony. The jacks on a jackup rig are very expensive. Strong legs for resisting large lateral forces are very expensive. They increase the expense of the jacks because they introduce bending forces into the jacks and thereafter into the vessel V. By bracing with means 194 and 195 two of the four legs found in jackups of the prior art can be omitted. Sometimes three legs are employed, but only two legs are provided in the apparatus of FIG. 73 and FIG. 74. The jackup of FIG. 73 and FIG. 74 can also move more rapidly through the water due to the rotatability of its legs. There need be very little bending strength in the element 192 and therefore there need be very little bending strength in the hull of the vessel V. A very small vessel can thus be operated as a jackup. The vessel V pictured in FIG. 73 and FIG. 74 is large, but a very small vessel indeed might be operated according to this teaching, while in methods of the prior art a certain minimum size would be required because legs 196 would have to be of a large diameter in order to resist bending forces due to the lateral action of the waves, and the vessel V would be required to be heavy to prevent overturning.

Figure 75:
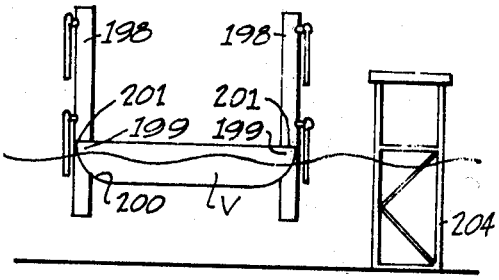
Figure 76:
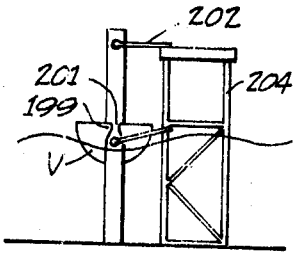
Figure 77:
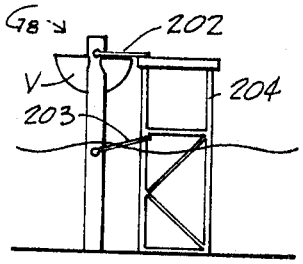

FIGS. 75, 76, 77 illustrate a similar two legged jackup which will be braced to the module 204 supported by piles P. The difference between FIGS. 75–77 and that which is pictured in FIGS. 73 and 74 is in the position of the legs and in the fact that they are not rotatable. In FIG. 75 there is pictured a vessel V approaching a station module 204 similar to the module 197 of FIG. 73. The vessel V has jackholders of a type not previously shown herein. The jackholders 199 of FIG. 75 have only one well 201 and previously each jackholder has had two wells and they have been outboard on the sides of the vessel. Here the jack wells 201 are not outboard the vessel. The jackholders are rudimentary structures incorporated directly into the vessel hull. It will be appreciated that many positions and types of jackholders could be employed, including simple base plates in the hull. Now, the advantage of having the leg wells 201 at the end of the vessel are obtained.

With reference to FIG. 75 there is shown vessel V having legs 198 run through the jack wells 201 in the holders 199 which are held to the vessel by means 200. In FIG. 76 the vessel draws alongside the module 204 rather than placing its stern against it as in FIG. 73. Advantages are that the legs 198 can be more readily braced by shorter connector 202. In the exemplary sequence illustrated, some advantages obtain by making the elements 203 shorter. It can be appreciated that in much taller structures having many modules 203 spaced up and down the legs 198 the advantages would be increases. The elements 203 would not need to be as strong and the legs 198 could be more slender. In FIG. 76 the elements 203 are connected from the legs 198 to the structure while the vessel floats. Subsequently (FIG. 77) the vessel has been raised by the apparatus $G_8$ which comprises 199, 200, 201, 202, and 203, to the level of the deck of the module 204. 202 has been made fast (FIG. 77) and the small vessel V is ready to do whatever work it came to do. The workover sequence has now been fully described.

Now a second advantage of including the jack wells directly into the vessel hull can be seen: the vessel hull is naturally a strong beam for spanning between supports, and this configuration capaitalizes thereon. With respect to all the figures heretofore illustrated, it should be noted that forms of jackholder are possible other than an elongate member athwart the vessel. Such members are only drawn for illustration, just as the vessels V are drawn with elongate shipshaped hulls. The invention might well be embodied in other hulls and other jackholders which are not illustrated here.

Another modification embodying the invention and which is well adapted for large development work will now be discussed. New features will be shown but many essential elements will be the same. FIGS. 78–90 illustrate such apparatus. The apparatus of FIGS. 78–84 is substantially the same and the apparatus of FIGS. 85–89 is the same. The common structure of both sequence in the ring-like structure or station module provided to lend support to the work equipment.

Figure 78:
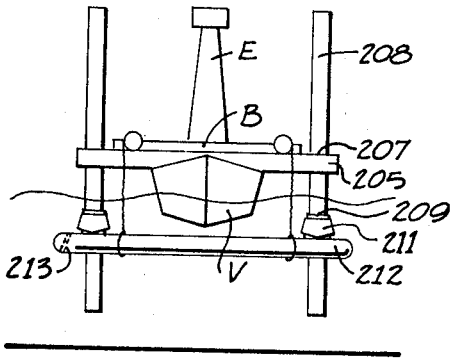
FIGS. 78–84 illustrate a further modification of the modular system concept in which a ring-like structure is utilized for supporting a jackup rig in medium depth water when a large number of wells are required for production.

With regard to the sequence of FIGS. 78–83, the vessel V is quite similar to the vessel V of FIG. 1 in that it has spacing-jack-and-coupling-means $G_9$ comprising jackholders 205 secured to the vessel V by means 206 and leg wells 207 at the end of the said jackholders 205 whereby the vessel may be supported on four legs 208 arranged in a rectangle about the vessel. Differences appear with respect to the connectors 209 and 210 and the station modules 211 and 212. In FIG. 78 there are pontoon-like footing members 212 having sleeves 209 therethrough. The modules 211 lie parallel across a ring-like module 212 which is the particular station module to be mainly considered here in the sequence of FIGS. 78–83. The modules 211 of course may serve as a station module in other sequences of steps. The connector 210 comprises a cable going to a winch mounted on the jackholder 205. The winch upon which the cable 210 is wound serves to lift up and hold up the module 212 when that is necessary in transit. The cable 210 is wrapped around the module 212. There are four (4) such cables 210 disposed in a rectangle whose corners are the four points on the module 212. The connector 209 comprises a sleeve passing fully through the module 211. The leg wells 207 in the end of the member 205 lie fully clear of the water therefore allowing the legs 208 to pass, in clear sight of an observer, through the legs wells 207 and through the connector sleeves 209. In FIG. 78 the connector sleeve 209 is welded to the means 208 so that there is a structure comprising 211 and 208 together. There are two structures comprising 211 and 208 together and each of the structures is thus an H-shaped frame. In a convenient and efficient manner there is a rig E disposed on a base B which lies athwart the decks of the vessel V. The sequence of drawings reveals the advantage that a convenient and efficient disposition need not be disturbed even while drilling a large number of wells with the apparatus of the figure.

Figure 79:
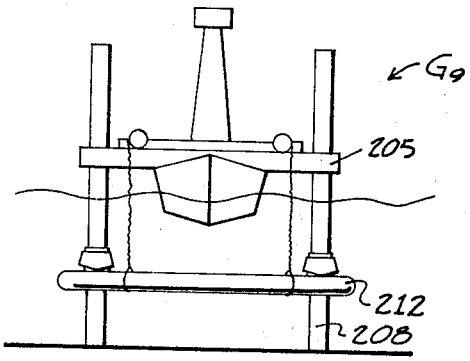
Figure 80:
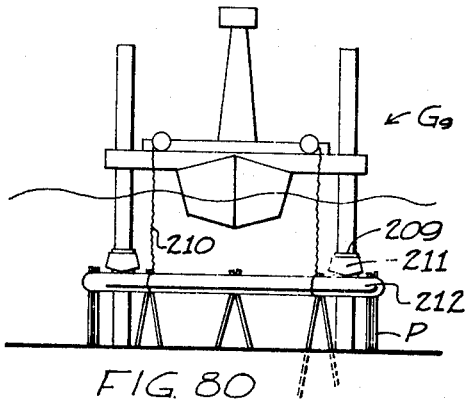
Figure 81:
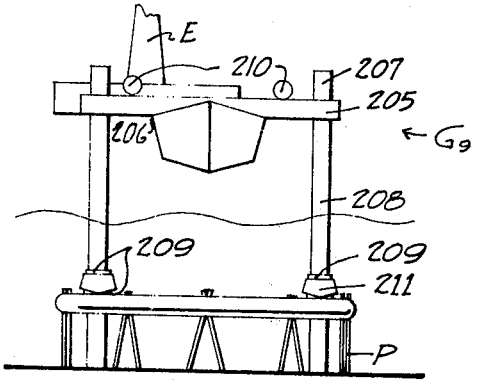
Figure 82:
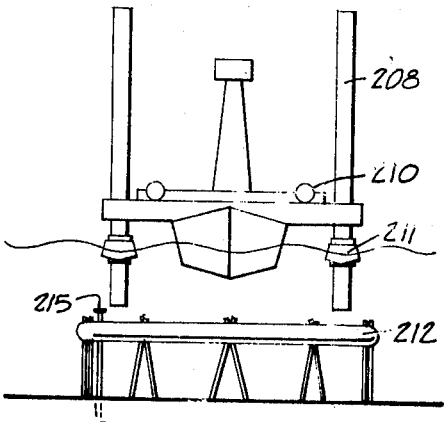
Figure 83:
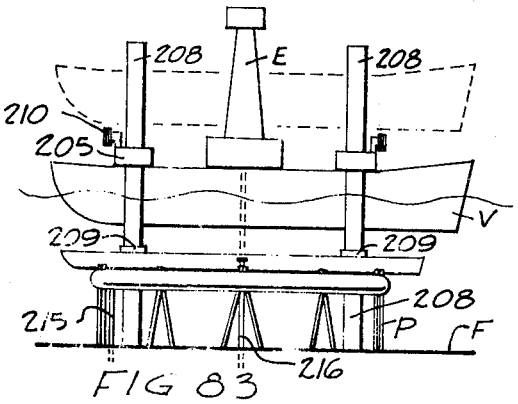

In FIG. 78 the vessel V is in transit having a ringlike module 212 carried therebeneath with the weight thereof supported by the connectors 210. In FIG. 79 the vessel has arrived at the station site and the apparatus $G_9$ comprising 205, 206, 207, 209, and 210 together have cooperated to lower the structure comprising 211 and 208 along with the module 212 to the marine floor in a position for stationing. It will be observed that the legs 208 contact the marine floor although they will not be called upon here to support the entire weight of the vessel. It is envisioned that in most situations it would be possible for them to do so. Situations where this might not be possible include circumstances in which the marine floor is a very soft mud. Even in such a case, however, the legs 208 embedded in the soft mud would prevent lateral motion of the ship permitting steps similar to those pictured to be completed. Returning to the sequence which is pictured, the legs 208 have engaged the marine floor and module 212 is now in a position to be founded and made stationary with respect thereto. In FIG. 80 piles are shown to have been inserted through the pile receiving means 213 in the module 212. The piles have been inserted in pairs, each pair forming a bipod, so that a series of bipods is disposed equally around the module 212. A preferred geometric array for such piles P would be as rulings on a hyperboloid of revolution of one sheet. This is not necessary but only a preferred arrangement and the arrangement which is pictured in FIG. 80. In FIG. 81 the vessel has been raised by the apparatus $G_9$ to an elevation clear of the waves. Depending on conditions, the weight of the vessel will be borne partly through the legs 208 and partly through the piles P. The marine floor, depending on its particular character, will support most of the weight through one or the other of the sources or it might support the weight equally between the legs 208 engaged in the marine floor and the piles P which are driven into the marine floor. In any case, the vessel is stably supported clear of the action of the waves and in such a condition as to allow drilling operations to begin. It will be observed that in the arrangement pictured in FIG. 80 and that pictured in FIG. 81 the means 210 has been released from the ring 212 so that it no longer resides in the water. The winches coupled to the cables 210 are now available for further work such as hoisting apparatus onto the decks of the vessel V, if it be desired to do so. It will be appreciated that the means 210 could be replaced by mobile cranes. The simpler arrangement shown in the drawings is shown only for illustration purposes. Rotary cranes such as are commonly found on offshore rigs would fulfill this function very well. In FIG. 81 the vessel V has been elevated by apparatus $G_9$ and the rig E has been moved on its base B to a position far outboard the vessel. This is the position most convenient for drilling, around the periphery of the ring, advantages of which will appear and will be explained. In FIG. 82 the well that the rig drilled from the position in FIG. 82 has been completed. The well is marked 215 in FIG. 82. In FIG. 82 the modules 211 have been withdrawn from their position atop the rings 212. They have been withdrawn by action of the apparatus $G_9$ operating in the same manner as has been pictured and shown before in this specification. The rig E has been returned to its position in the center of the vessel. The vessel V is now free to float and leave the site if it should be desired to have it leave the site. However, that is not what is pictured as will be seen in FIG. 83. In FIG. 83 the rig is shown after the drilling of another well 216. FIG. 83 is a side view of a position similar to the position of FIG. 79. The steps that have transpired between the situation pictured in FIG. 82 and that pictured in FIG. 83 are as follows: The vessel was revolved through 90° from its picture in FIG. 82. The modules 211 were returned to contact with the ring 212. The vessel V was elevated by apparatus $G_9$ above the action of the waves again. The rig was moved outboard to a position similar to the position of FIG. 81. The well 216 was drilled from that position and the well was completed, then the vessel V was returned to the waves as pictured in FIG. 83. The vessel is free to leave or to drill other wells in a similar manner as might be desired. The considerable advantages obtained from the sequence that is illustrated will now be explained. Of first advantage is that the ring-like structure is quite strong and is well adapted to uses requiring structural strength. For example, the ring-like structure is well adapted to receive a spherical vessel as will be explained and described in FIG. 90 later. An important advantage relates to the efficient disposition of the rig E and its associated apparatus on the deck of the vessel V. Only one arrangement is best from the standpoint of working. A vessel has limited decks and limited space and a limited amount of apparatus and there is one most efficient disposition of the apparatus on the deck of any vessel. In the prior art either the vessel must be moved with respect to the well, which is actually the situation that is described here, although the advantages that are shown here do not accrue to the prior art; or else the rig must be skidded around on the deck of the vessel thereby disturbing the most efficient arrangement, requiring additionally skids on the deck which intefere with the arrangement. In the case shown, a very large number of wells could be drilled without disarranging the deck of the vessel. The vessel is simply revolved and placed in a different orientation on the ring 212. For example, the wells 215 and 216 are at 90° to one another in the figures being discussed. However, other wells could certainly be drilled at 5° intervals if it were so desired yielding say 72 wells around the ring 212. In the prior art no such convenience is obtained. Other advantages of having the wells in a ring-like array about the well supporting structure are as follows: If production apparatus be placed at each one of the wells, then the production apparatus will interfere with the rigs being placed around the work 30 over the well if one should become stopped up, where with the arrangement shown, a workover rig can apparatus the ring from the side and not disturb production apparatus which might be placed in the center of the ring-like structure. Another advantage is that if it is necessary to stabilize a vessel while driving piles through the sleeves 209, the modules 211 provide a means for so stabilizing the vessel. It may be noticed that the legs 208 are engaged in the marine floor. However, after the ring is once founded, if it were desired to extend the reach of the legs so that the vessel might be raised to a higher position than that shown in FIG. 81, it would be possible to release the connectors 209 from the legs 208 so that the legs 208 could be withdrawn and so that only their tips would reach the means 209 therefore the vessel V would be placeable at a higher elevation than that shown in FIG. 81. Various conditions might warrant this. For example, it might be desirable to use a rig in waters deeper than the waters illustrated, or it might be desirable to raise the vessel to a higher position in anticipation of a severe storm. An advantage accruing to all the apparatus is that the vessel can be quickly removed in case of a storm, leaving the wells supported by the ring-like module 212. Another advantage is that the vessel shown may be operated precisely as is the vessel of FIG. 1 so that none of the advantages illustrated in FIG. 1 need be lost by operation according to the sequence of FIGS. 78–83. For example, the modules 211 might be removed causing the vessel of FIG. 78 to appear very much the same as the vessel of FIG. 1. Alternatively, the modulus 211 might be left on, but re-spaced and replaced at the tips of the legs 208, so that the operation similar to operations of FIGS. 7–30 could be obtained using the apparatus of FIGS. 78–83. One of the greatest advantages of the present invention is that operation advantageous to the conditions at hand can be obtained without the loss of the ability to operate under other conditions. Another important advantage of all the apparatus illustrated is that the legs 208 might be removed entirely from the Legholders 207 thereby allowing the vessel to pass through constricted places such as the Panama Canal. Other advantages discussed elsewhere will, of course, also apply to the FIGS. 78–83.

Figure 84:
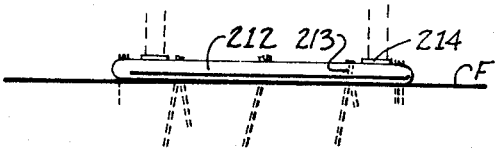

FIG. 84 is used to illustrate that the ring-like module 212 lying on the marine floor thus evidencing the fact that it need not have been placed above the level of the mud, thereby doing away with the necessity for having a means 209 being a sleeve through a module 211. FIG. 84 also illustrates that the connector for the legs 208 might be a simple socket disposed atop the ring 212. The socket is marked 214 in FIG. 84.

Figure 85:
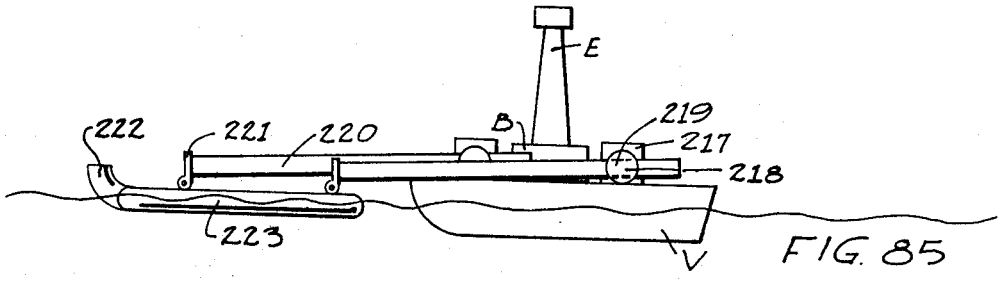
FIGS. 85–96 illustrate a modification to the structure of FIGS. 78–84 for use in relatively deep water, this being accomplished by the rotatable leg means, similar to the sequence of FIGS. 52–58.
Figure 86:
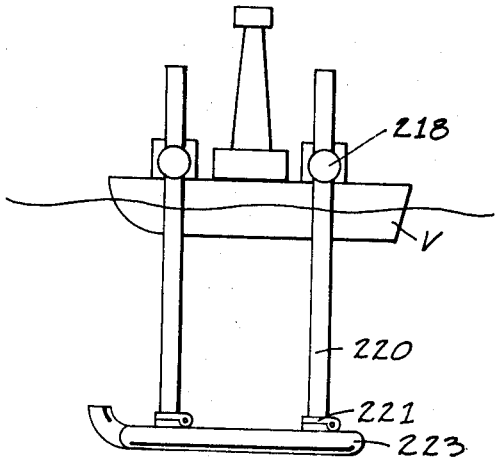
Figure 87:
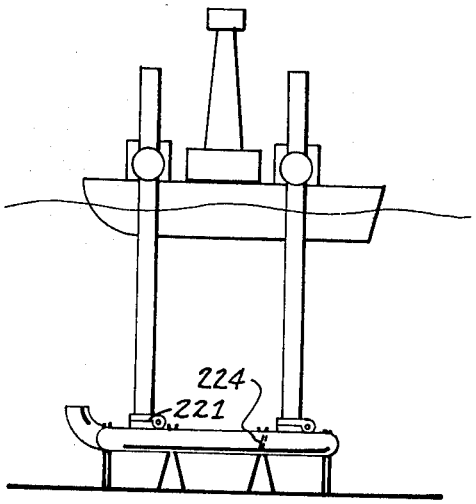
Figure 88:
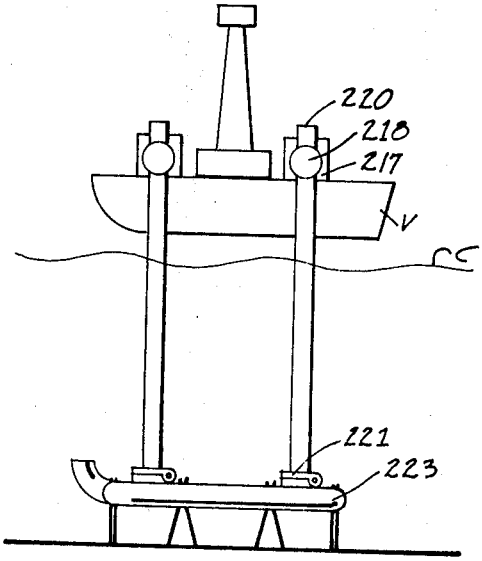
Figure 90:
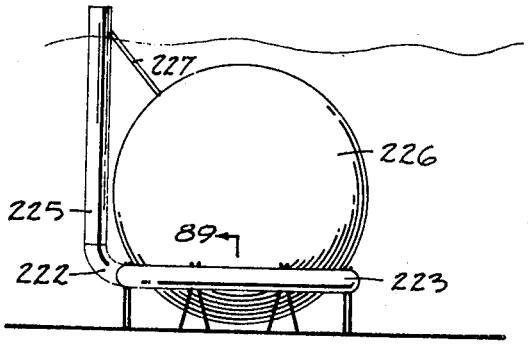
Figure 89:
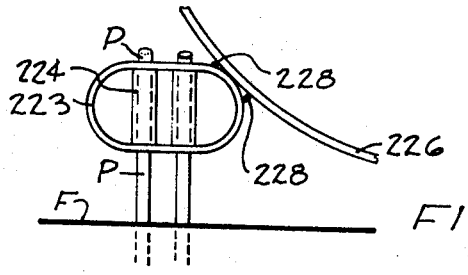

The sequence of FIGS. 85–88, and then later extending to FIGS. 89 and 90, expands the advantages of previous figures to include their operation in deeper waters and to exploration sites far from the shore. The apparatus of FIG. 78 presents a considerable impediment to passage through the water in contrast to the apparatus of FIG. 85. The apparatus of FIG. 85 therefore has some of the advantages pictured in the apparatus of FIG. 7. In each of the latter cases the rig can pass through shallow water without having a large structure far overhead causing the vessel to be unstable. In FIG. 85 there is a vessel V having pillow blocks 217 similar to the pillow blocks 138 of FIG. 52. Other pivotal hearing means might be employed, or other connectors allowing rotation. There is also a means 218 similar to the means 139 of FIG. 52 which likewise might have a different character from that illustrated. In any case, there are leg wells 219 in the ends of the means 218, and the leg wells 219 may be rotated through means 218, therefore allowing rotation of means 220. The means 220 are legs similar in many respects to the legs of FIG. 52. The legs differ in one respect, however. At their bottoms there is a hinge 221. Advantages with respect to a stable foundation preventing overturning of the jackup rig illustrated in the figure would still be obtained. Conversion of the ring 223 to a production structure would not be obtained without releasability of the means 221, however, and it is for this reason that the means 221 is pictured to be releasable. Releasability could be obtained by removing the hinge pin by any number of means as by diving or as by using an explosive connector in the hinge pin which would release the leg 220 from the ring 223. There is a ring 223 which is similar to the ring 212 of the just preceding figures. On the vessel V there is base B with exploration apparatus E, a rig similar to the rigs in the preceding figures. The front jackholder 218 will be observed as somewhat longer than the rear jackholder 218. It will be appreciated that the rear jackholder 218 might house only a single leg rather than the two legs illustrated, thereby making a three-legged jackup. However, four legs are illustrated. Each leg pictured conceals another parallel leg which is directly behind it as the view is taken. The front jackholder 218 is longer so that the front legs may pass the rear legs as illustrated. The sequence of operations may now be described. In FIG. 85 the vessel V travels through the water towing the module 223 behind it. The means 217 and the means 221 have been released with respect to rotation so that the module 223 may freely move in an arc with respect to the axis of the means 218, thus oscillating in the means 217 so that the module 223 may bob up and down in the water behind the vessel. This is, of course, not a necessary arrangement. The module 223 might very well be supported clear of the water by locking the means 217. In FIG. 86 the module 223 has been driven into the water. Two means are available to do this and the means envisioned consists of powering the legs downward, possibly by attaching crane lines to the legs 220. In any event, those skilled in the art will be well able to provide means to urge the module 223 into the water. Another means is available, however, which is the ballasting of the module 223. If the module 223 were ballasted by introducing water into it, then it would sink and draw the legs 220 along with it, to the position shown in FIG. 86. In either case, the position of FIG. 86 can be obtained. In FIG. 86 the vessel floats on the waves and tensile forces in the legs 220 support the module 23 if the module 223 be ballasted. However, as shown, it will be compressive forces in the legs 220 because the module 223 is pictured as being not ballasted but as being empty of water, therefore containing air and certain requisite apparatus. In FIG. 87 the module 223 has been founded by driving piles P through the means 224 in the module 223 similar to the means pictured for the module 212 of FIG. 80. In FIG. 88 the vessel has been elevated above the water just as the vessel was elevated above the water in FIG. 81. FIG. 81 is, of course, a front view and FIG. 88 is the side view. The two views are directly comparable, however, and it will be observed that the hinge means 221 of FIGS. 85–88 do away with the necessity for the winches 210 illustrated in FIGS. 78–83. The sequence is similar to the sequence of FIGS. 78–83 which could be exercised by the apparatus of these FIGS. 85–88. However, this would entail making the hinge means 221 releasable from the ring-like module 223. This might be desirable in some situations, however, that is not the situation pictured. Instead there is shown one leaf of the hinge 221 permanently attached to the ring 223 and the means 221 is releasable by removal of the hinge pin. It may be well appreciated that numerous extra leaves could be provided on the ring 223 with extra hinge pins allowing the vessel V to be positioned in a variety of positions around there. In the situation illustrated, the vessel could be revolved through an angle of 180°, the legs 220 could be rotated to 180° in their housings 219, and the position of the vessel could be reversed. Without extra leaves for means 221, no other positions could be readily obtained.

The sequence of FIGS. 85–88 is directly comparable to the sequence of FIGS. 78–83. Now, FIG. 89 illustrates details which might be common to the operation of both sequences of FIGS. 78–83 and 85–88. FIG. 89 is a section taken through the ring 223 of FIGS. 85–88. The ring 212 might be likewise similarly represented. The broken arc represents a possible position for curved (spherial) or other vessel, such as shown in FIG. 90. Here there is illustrated (FIG. 90) a completed installation having the elbow 222 unchanged except that a column 225 having elevator or stair means therein reaches above the surface of the waves. There is a spherical vessel 226 used for production purposes and for storage purposes and a brace 227 which supports and braces the elevator means 225 to the spherical vessel 226. The means 225 allows personnel to descend through the elbow 226 to open a door in it, if a door be provided, and to enter the ring 223 thereby allowing access to the pile sleeves 224 for inspection of the connections to the piles P and also thereby allowing the completion of connections 228 illustrated in FIG. 89 which will now be explained. The connectors 228 are ring-like gaskets of a diameter close to the major diameter of the rings 223 therefore extending all around the sphere 226. Therefore, when a person enters the ring 223 through the access means 222, he will be able to cut with a torch through the part of the ring 223 which is directly between the connectors 228. The connectors 228 will seal out water and make it not possible for it to enter the ring 223 and drown the man working therein. Then the man working therein will be able to make a weld of the ring 223 to the spherical vessel 226 so that the spherical vessel will not float away when it is de-ballasted. Thus the spherical vessel will contain petroleum and the ring 223 may contain apparatus. It will, of course, be appreciated that other vessels than 226 could be provided having a great deal of prefabricated and pre-arranged and pre-installed apparatus therein so that when the vessel 226 is delivered and deposited on the ring or station module 223, it can be positioned by simple welding to the ring 223. All of the space within the spherical vessel 226 could be available for housing apparatus and equipment. However, the situation pictured is that the vessel 226 is provided to house only fluids such as petroleum. The ring 223 is, of course, available for production purposes and pumps and other apparatus might be located therein along with work spaces for men.

The ring-like structure of FIGS. 85–90 is, of course, rudimentary and it will be clearly understood and appreciated that the ring-like structure 223 might be of any degree of complexity, being itself a large complicated ring with many work chambers therein, airlocks and pre-installed and prefabricated apparatus planted for any variety of work; for example, Christmas trees, pumps, compressors, connectors and crew quarters could be housed in such a complex ring-like structure. It should be clearly understood that all of the figures have this schematic character and are designed to illustrate a rudimentary form of the invention.

Figure 91:
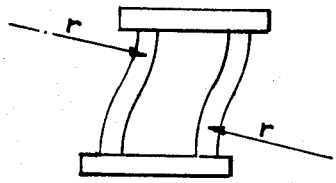
Figure 92:
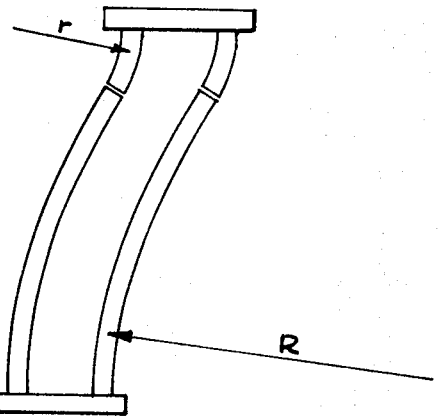

Now the FIGS. 91–96 will serve to illustrate certain structural principles that are common to the various embodiments of the invention. An essential aspect here is noted. In the prior art, mobile rigs are built as a unitary whole. They are not built with a view to modularity and they are not built with a view to the changing of the structures which support the weight of the vessels. This is different from the situation pictured herein before and made possible by the present invention. FIG. 91 illustrates the situation obtained, for example, in a mat-type jackup of the prior art. The mat-type jackup is made with legs which are not intended to be removable and with a mat which is intended to cooperate permanently with a vessel. The horizontal member at the top of FIG. 91 can be taken to be the counterpart of a barge in a mat-type jackup of the prior art. The lower horizontal member can be taken to be the counterpart of the mat. The two vertical members can be taken to be the counterparts of the leg. It will be seen that if the jackholders or the legs wells or the spud wells, or whatever they might be analogously called in the prior art, receive the legs at their upper ends if they restrain the legs and tend to hold them in a vertical position through the structural stiffness and strength of the barge body; and if the mat does the same at the bottom, then the situation pictured will be obtained. The bending moment at the bottom of the legs will be similar to the bending moment at the top of the legs; another way of saying the same thing is that if the legs be constant in their cross section, the radius of curvature will be similar at the top to what it will be at the bottom. Therefore, the structural strength of the legs at their tops and at their bottoms will have been determined during the design of the vessel. The vessel will not be available nor operable for uses in other depths than those for which it was designed. Another situation, not pictured, is the situation wherein the leg wells at their tops are not intended to restrain the legs so that only a single radius of curvature would be obtained if the legs attached to the mat were coupled with respect to moment only to the mat and not to the leg wells themselves. The advantages of this situation have been obtained in the present invention, but such is not the subject of discussion here. The subject of discussion here has to do with restraint against bending at the tops of the legs. The situation pictured in FIG. 92 is the situation made possible by the present invention. There is connector K the equivalent being pictured throughout the figures of the present invention and there are legs L along with connectors K and there is a station module M which is coupled, often to the legs L, but sometimes to other parts of the apparatus, and it is the connector K which tends to isolate the mobile rig from the bending of the station structural module M. The structural module M can then be adapted to conditions which are found locally rather than being adapted once and for all to the design of the rig. It will be seen that the large capital letter R denoting a large radius of curvature associated with a large bending moment in the module M compares to the small letter r which denotes a small radius of curvature or a small bending moment in the legs of the mobile rig superimposed above the module M. Thus it is seen that the design of the module M is self contained and related only to local conditions and that by re-design of the module M a mobile rig can be adapted to any of a very wide variety of conditions. It is not necessary to have the connector K be fully separable so that the mobile rig can be removed from the module M in order to obtain the advantages of the present invention. It is only necessary that it liberate the vessel V in some manner from the effects of the water on the structure M to obtain the advantages of the present invention.

This paragraph will review other advantages related to those just disclosed. In the situation mentioned just above wherein the leg wells are not provided with bending strength for preventing overturning of legs therein, or the analogous situation with tensile cable legs having no bending strength, the same situation occurs. The vessel may be designed independently of its supporting station module, which may be designed to suit conditions of use, so that the advantages of the present invention are still obtained.

Figure 93:
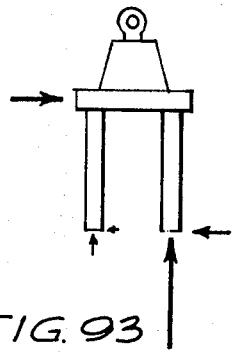
Figure 94:
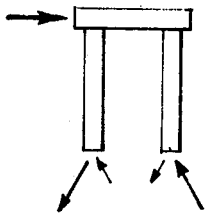
Figure 95:
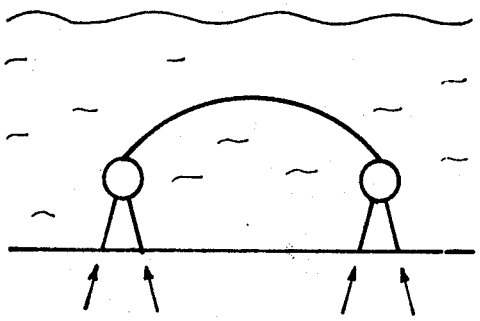

FIG. 93 pictures the situation of the prior art where a mobile rig which is bottom supported must be sufficiently heavy that the lateral forces which form a couple, those due to the waves and those due to the mud, which tend to overturn the mobile rig. The weight of the mobile rig must be sufficient to overcome this. The moment of restitution of the mobile rig must exceed the overturning moment or the mobile rig will be overturned. Therefore, although much advantage in cost and mobility could be obtained by making mobile rigs lighter than they are presently made, it cannot be done because they would be overturned by the waves. The situation obtained in the present invention is illustrated in FIG. 94, which is a schematic representation of the structural action of such apparatus as in FIG. 22, for example. The piles imbedded in the mud exert both tensile and compression forces, therefore the mobile rig may be lighter, for the moment of restitution resulting from the weight of the rig is not the only righting moment available; righting moment is obtained by the tensile strength in the piles driven into the mud thus a mobile rig may be made lighter and therefore more mobile and more economical by the employment of the piles of the present invention. The mobile rig has departed, in the situation pictured in FIG. 95, which is a structural schematic view that might be compared to the sequence of FIG. 2 or the apparatus of FIG. 90. In particular, this is schematic and more applicable to FIG. 4. When no bouyant fluid is contained within the station module, the piles tend to support the weight of the station module in compression. When a bouyant fluid is in the station module, the piles tend to support it in tension. Therefore it can be seen that not only do the piles in their divergent pattern tend to support the rig against lateral forces when the rig is present but they also tend to support the station module in a superior manner after the rig has departed.

Figure 97:
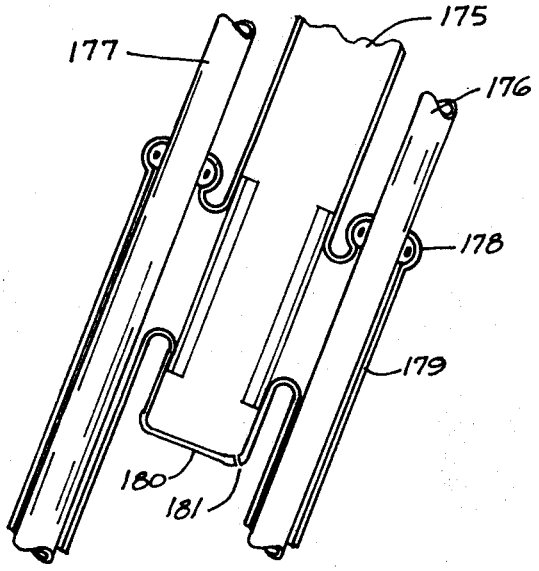
FIGS. 97 and 98 show means for securing a piling to a leg.
Figure 98:
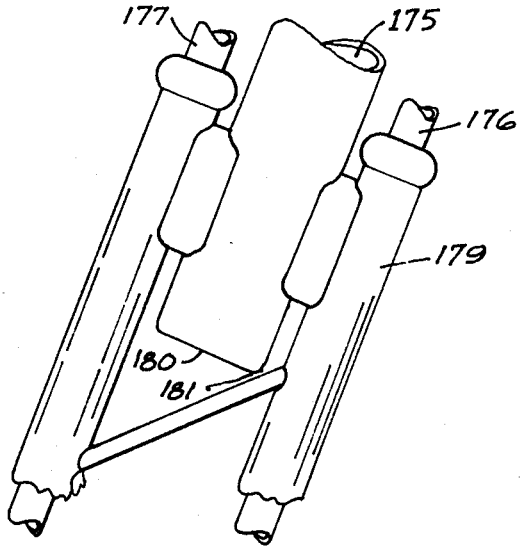

Attention is next directed to FIGS. 97 and 98 of the drawings which are a sectional view and an elevational view of means for connecting the pilings 176 and 177 to a leg 175. A surrounding jacket 179 extends fully about the pilings 176 and 177. The lower end of the leg is indicated by the numeral 180. The leg 175 opens through doors into the jacket surrounding the pilings, and at the nacelles for working access. The jacket 179 has a bead about its upper perimeter and a hose or other conduit 178 is placed within the head of the jacket. The hose communicates fully about the circumference of the pilings 176 and 177 and also about the leg 175. Using available techniques, the hose 178 is inflated to seal against leakage.

Air under pressure and forced down the legs 175 forces water in the leg chamber out through a chamber vent 181. Once the leg chamber is freed of water, a workman given access to the leg chamber. By the use of sealed opening from the leg chamber to the nacelles formed in the jacket 179, the workman has access to the individual pilings. Each is then fixed to the nacelle by means such as a stop collar welding and the like. On completion, inspection is permitted. Thereafter, the workman may leave the chamber by egressing through the leg and the perhaps temporary seal 178 in the bead may even be released.

Figure 99:
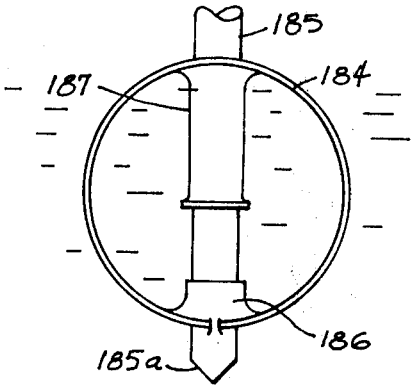
FIGS. 99–102 show a method of connecting pilings through a footing member.

Reference is next made to numerous past views wherein a substantially cylindrical footing member or pile cap is shown. For instance, a pair of footing members shown in FIG. 4 have several pilings connected to each footing and the seqences thereafter. If the platform above the structure is, say, one hundred feet long, the cylindrical footing member may also range up to one hundred feet long. With this in view, attention is directed to FIG. 99 illustrating in section view a portion of the cylindrical footing member which receives the pilings members through guide means to be noted. In FIG. 99, a piling 185 having a lower end 185*a* is urged through the footing member 184. A lower guide 186 and an upper guide 187 direct, align and position the piling 185. The piling is inserted through the guide means before the connection is made between the piling and the footing member.

Figure 100:
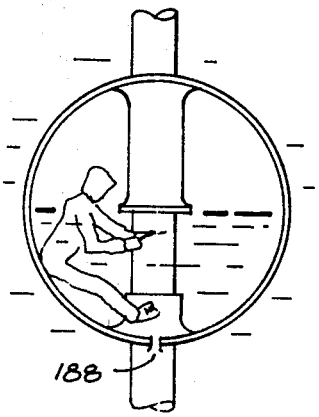
Figure 101:
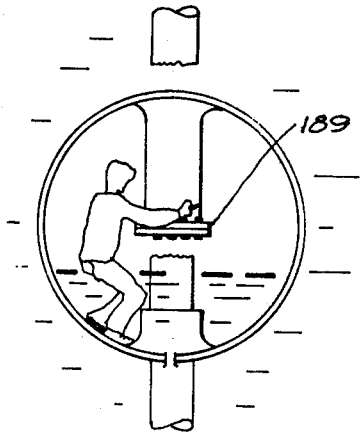
Figure 102:
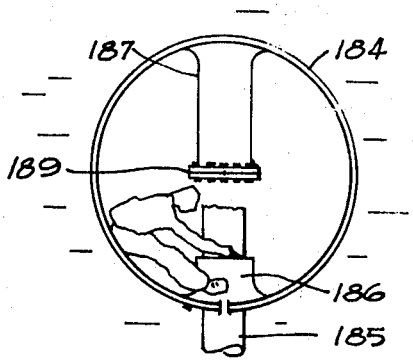

To fasten a piling to the pile cap, the chamber within the footing member 184 is partially purged of water as shown in FIG. 100. Air is forced into the chamber and both a lower opening 188 and the annular crevice around the pile provide escape for part of the water. The chamber is partially purged to permit entrance of a workman gaining access to the exposed piling 185. The workman enters the chamber and may utilize appropriate means to cut the piling 185. If the piling has excess length, the upper unneeded portion, when cut free above the guide means 186, is removed as shown in FIG. 101. This then permits the workman to attach a cover plate 189 to the upper guide means 187 to seal off the chamber from water entering through the upper guide means 187. Alternatively, other means could be used to seal off the communication to the outside through the upper guide means, perhaps without need to remove the upper part of the piling, selaing the guide means 187; this leaves the chamber air tight and permits the complete purging of water from the chamber. This then permits the workman better access to the lower guide means 186 and the piling 185. The workman is then enabled to place any desired sealant between the piling 185 and the inner wall of the guide means 186 to caulk off the chamber. The connection between piling and footing may then be perfected as needed.

The invention claimed is:

1. An offshore marine structure for receiving and holding a tank comprising a toroidal tubular footing member having therethrough a plurality of pile guides and holding sleeves means for guiding and holding a piling, and a piling, said piling being secured in said sleeve and being driven into the marine floor in downwardly divergent bipodal array and said tubular footing being adapted to receive and hold a tank means.

2. The offshore marine structure according to claim 1 wherein said tank means is spherical.

3. The offshore marine structure according to claim 1 wherein each of said bipods conforms to a clockwise ruling on a hyperboloid of revolution of one sheet and an opposing ruling corresponding to counterclockwise ruling on a hyperboloid revolution of one sheet.

* * * * *